US011205524B2

(12) United States Patent
Raman et al.

(10) Patent No.: US 11,205,524 B2
(45) Date of Patent: Dec. 21, 2021

(54) INTEGRATED ATOMIC BEAM COLLIMATOR AND METHODS THEREOF

(71) Applicant: Georgia Tech Research Corporation, Atlanta, GA (US)

(72) Inventors: Chandra Raman, Atlanta, GA (US); Farrokh Ayazi, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 17/055,931

(22) PCT Filed: May 17, 2019

(86) PCT No.: PCT/US2019/032820
§ 371 (c)(1),
(2) Date: Nov. 16, 2020

(87) PCT Pub. No.: WO2019/222594
PCT Pub. Date: Nov. 21, 2019

(65) Prior Publication Data

US 2021/0210247 A1 Jul. 8, 2021

Related U.S. Application Data

(60) Provisional application No. 62/672,709, filed on May 17, 2018.

(51) Int. Cl.
*G21K 1/02* (2006.01)
*G04F 5/14* (2006.01)

(52) U.S. Cl.
CPC . *G21K 1/02* (2013.01); *G04F 5/14* (2013.01)

(58) Field of Classification Search
CPC ..... G21K 1/02; G21K 1/025; G04F 5/14
(Continued)

(56) References Cited

U.S. PATENT DOCUMENTS 3,675,149 A 7/1972 Cutler et al.
4,558,218 A 12/1985 Drullinger
(Continued)

FOREIGN PATENT DOCUMENTS

CN 106601323 4/2017
JP 2013125907 6/2013

OTHER PUBLICATIONS

International Search Report and Written Opinion from Application No. PCT/US2019/032820 dated Aug. 7, 2019 (15 pages).

*Primary Examiner* — Michael Maskell
(74) *Attorney, Agent, or Firm* — Troutman Peper Hamilton Sanders LLP; Ryan A. Schneider

(57) ABSTRACT

Embodiments of the present disclosure relate to atomic beam collimators and, more particularly, to miniaturized coplanar atomic beam collimators. In some examples, an atomic beam collimator may comprise an atomic channel disposed in a substrate. Additional atomic channels may be provided coplanar with the first atomic channel in the substrate. Some examples include a series of cascaded atomic channels, each cascaded atomic channel separated by a gap. The gaps may reduce the off-flux atoms in the output of the atomic collimator. In some examples, a system may comprise an atomic collimator, an atom source, and/or a microelectromechanical system device. These component can be separate devices or can be incorporated into a common substrate.

20 Claims, 15 Drawing Sheets

(58) Field of Classification Search
USPC ..... 250/505.1, 251
See application file for complete search history.

(56) References Cited

U.S. PATENT DOCUMENTS

| | | | | |
|---|---|---|---|---|
| 4,874,942 | A | 10/1989 | Clauser | |
| 8,648,315 | B1 * | 2/2014 | Hailey ..... | H01J 37/08 250/396 R |
| 2006/0011865 | A1 | 1/2006 | Migeon et al. | |
| 2007/0084991 | A1 | 4/2007 | Lee et al. | |
| 2013/0023125 | A1 | 1/2013 | Singh | |
| 2017/0051883 | A1 | 2/2017 | Raring et al. | |
| 2017/0342542 | A1 | 11/2017 | Ghosh et al. | |

* cited by examiner

Base Substrate
104
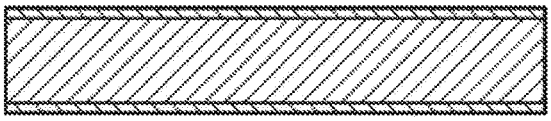
FIG. 6A
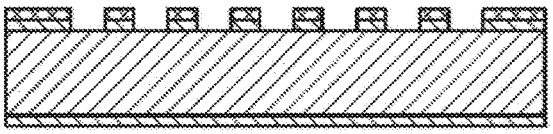
FIG. 6B
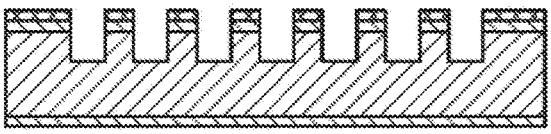
FIG. 6C
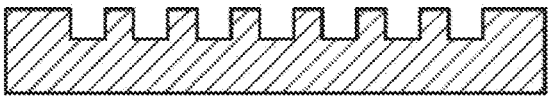
FIG. 6D
Capping Substrate
602
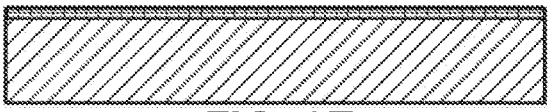
FIG. 6E
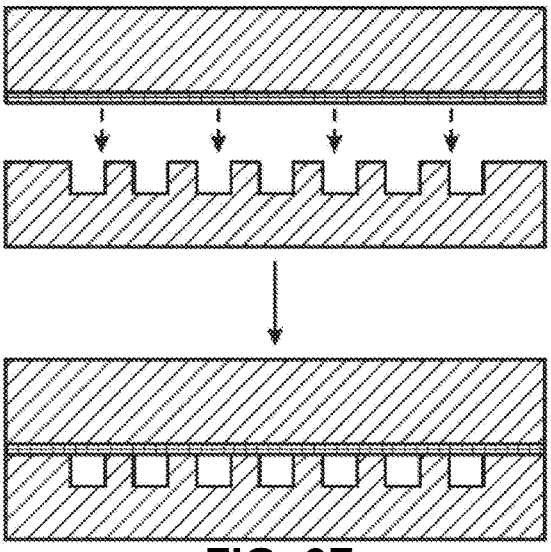
FIG. 6F
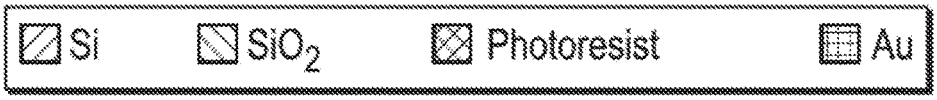

INTEGRATED ATOMIC BEAM COLLIMATOR AND METHODS THEREOF

CROSS-REFERENCE TO RELATED APPLICATIONS

This Application claims priority to U.S. Provisional Patent Application No. 62/672,709, filed 17 May 2018, which is hereby incorporated by reference herein in its entirety as if fully set forth below.

STATEMENT OF RIGHTS UNDER FEDERALLY SPONSORED RESEARCH

This invention was made with government support under Grant No. N00014-17-1-2249 awarded by the Office of Naval Research. The government has certain rights in the invention.

FIELD OF THE DISCLOSURE

Embodiments of the present disclosure relate to atomic beam collimators and, more particularly, to miniaturized coplanar atomic beam collimators.

BACKGROUND

Atomic beam technology has profoundly influenced both fundamental atomic science as well as its practical applications. Atom beams have, for example, played a critical role in enabling GPS and modern communication and navigation systems. From a scientific standpoint, the ability to produce collimated beams of freely moving atoms in an evacuated container has enabled a detailed and precise measurement of atomic properties. These atomic properties include electronic level structure and fine and hyperfine interactions. Such beam techniques have also significantly influenced modern physical chemistry and material science by allowing controlled geometries for atomic and molecular collisions. This influence has improved the scientific community's understanding of chemical pathways and quantitative determination of chemical rate constants.

Equally far-reaching has been atomic-beam technology's practical utility, as commercially available beam clocks deliver portable, accurate time. By counting time increments via the hyperfine interval in atomic cesium, the clocks form a cornerstone of the Global Positioning System (GPS) for telecommunication, space communication, and navigation.

A typical approach to free space atomic beam generation uses an array of capillaries connected on one end to a high density atomic vapor. These are usually fabricated by bundling together metal or drawn glass tubes, with a large aspect ratio l/d between the length of each tube l and its diameter d. Collimation is achieved by limiting the divergence angle HWHM (half-width at half-maximum of the flux angular distribution) $\theta_{1/2}$, roughly equal to 0.8 d/l. Accordingly, current atomic beam collimators present significant limitations in terms of size and control.

First, the size of the current systems undermine the ability of the collimators to be used in micro- or nano-scale systems, for example in hybrid atom-MEMS systems. The main drawback is the mismatch in size between a several-meter-long highly collimated atomic beam apparatus and the nanometer length scales relevant for interactions with device surfaces, which makes alignment of source and target challenging. Additionally, the three-dimensional, non-planar design of current collimator systems enlarge the system as a whole, further decreasing their utility in small-form devices.

Next, current systems lack sufficient control. As described above, current collimation is achieved by limiting the divergence angle HWHM, which is the only adjustable parameter with the current systems. What is needed, therefore, are systems and methods that provide a continuous atomic beam, provide a small platform for use in micro- and nano-scale devices, and are customizable to improve the signal of the collimated atomic beam.

SUMMARY

Embodiments of the present disclosure address these concerns as well as other needs that will become apparent upon reading the description below in conjunction with the drawings. Briefly described, embodiments of the present disclosure relate to atomic beam collimators and, more particularly, to miniaturized coplanar atomic beam collimators.

An exemplary embodiment of the present invention provides a system. The system can include an atomic beam collimator. The atomic beam collimator can comprise a first substrate. The atomic beam collimator can further comprise a first atomic channel disposed in the first substrate. The atomic beam collimator can further comprise a second atomic channel disposed in the first substrate. The first atomic channel and the second atomic channel can be coplanar.

In any of the embodiments described herein, the system can further comprise an atom source that can be configured to emit a plurality of atoms, such that a first portion of the plurality of atoms pass through the first atomic channel and a second portion of the plurality of atoms pass through the second atomic channel.

In any of the embodiments described herein, the atomic beam collimator can further comprise a third atomic channel disposed in the first substrate. The third atomic channel can be coplanar with the first atomic channel and the second atomic channel.

In any of the embodiments described herein, the first substrate can comprise a first side and a second side, and the first and second atomic channels can be disposed in the first side of the first substrate. The system can further comprise a second substrate positioned adjacent to the first side of the first substrate. The second substrate can cap the first and second atomic channels.

In any of the embodiments described herein, the second substrate can comprise a first side and a second side, the first side positioned adjacent to the first substrate. The system can further comprise a third atomic channel disposed in the second side of the second substrate and a fourth atomic channel disposed in the second side of the second substrate. The third atomic channel and the fourth atomic channel can be coplanar.

In any of the embodiments described herein, the atomic beam collimator can further comprise a third substrate positioned adjacent to the second side of the second substrate. The third substrate can cap the third and fourth atomic channels.

In any of the embodiments described herein, the first and second atomic channels can be parallel along the substrate.

In any of the embodiments described herein, the first and second atomic channels can have a first end and a second end, the respective first ends proximate the atom source and the respective second ends distal to the atom source. A first distance between the first ends of the first and second atomic channels can be greater than a second distance between the second ends of the first and second atomic channels.

In any of the embodiments described herein, the first and second atomic channels can be parallel along the substrate, and the third atomic channel can be non-parallel to the first and second atomic channels.

In any of the embodiments described herein, the first and second atomic channels can comprise a first and second end, and the first ends of the respective atomic channels can be disposed proximate the atom source. The system can further comprise a microelectromechanical system device disposed proximate the second ends of the respective atomic channels. The microelectromechanical system can be configured to receive atoms from the first and second atomic channels.

In any of the embodiments described herein, the microelectromechanical system device can be disposed on the first substrate.

In any of the embodiments described herein, the first atomic channel and the second atomic channel can comprise a length and a width. The length of the first and second atomic channels can be from 50 μm to 10 mm, and the width of the first and second atomic channels can be from 50 nm to 300 μm.

In any of the embodiments described herein, the atomic beam collimator can further comprise a third atomic channel disposed in the first substrate and colinear with the first atomic channel. The atomic beam collimator can further comprise a first gap disposed between the first atomic channel and the third atomic channel. The atomic beam collimator can further comprise a fourth atomic channel disposed in the first substrate and colinear with the second atomic channel. The atomic beam collimator can further comprise a second gap disposed between the second atomic channel and the fourth atomic channel.

In any of the embodiments described herein, the atom source can comprise alkaline or alkaline earth atoms. The atom source can, responsive to heat, emit the plurality of atoms.

In any of the embodiments described herein, the first substrate can comprise at least one of silicon carbide, aluminum nitride, polycrystalline silicon carbide, polycrystalline silicon, monocrystalline silicon, diamond, a metallic substrate, or fused quartz.

Another exemplary embodiment of the present invention provides a system. The system can comprise an atomic beam collimator. The atomic beam collimator can comprise a first substrate. The atomic beam collimator can further comprise a first atomic channel disposed in the first substrate. The atomic beam collimator can further comprise a second atomic channel disposed in the first substrate and colinear with the first atomic channel. The atomic beam collimator can further comprise a first gap disposed between the first and second atomic channels.

In any of the embodiments described herein, the atomic beam collimator can further comprise a third atomic channel disposed in the first substrate. The atomic beam collimator can further comprise a fourth atomic channel disposed in the first substrate and colinear with the third atomic channel. The atomic beam collimator can further comprise a second gap disposed between the third and fourth atomic channels. The first, second, third, and fourth atomic channels can be coplanar.

In any of the embodiments described herein, the system can further comprise an atom source configured to emit a plurality of atoms, such that at least a first portion of the plurality of atoms pass through the first atomic channel and at least a first portion of the first portion of plurality of atoms pass through the second atomic channel.

In any of the embodiments described herein, the system can further comprise an atom source configured to emit a plurality of atoms, such that at least a first portion of the plurality of atoms pass through the first atomic channel, at least a first portion of the first portion of plurality of atoms pass through the second atomic channel, at least a second portion of the plurality of atoms pass through the third atomic channel, and at least a first portion of the second portion of the plurality of atoms pass through the fourth atomic channel.

In any of the embodiments described herein, the atomic beam collimator can further comprise a fifth atomic channel disposed in the first substrate. The atomic beam collimator can further comprise a sixth atomic channel disposed in the first substrate and colinear with the fifth atomic channel. The atomic beam collimator can further comprise a third gap disposed between the fifth and sixth atomic channels. The first, second, third, fourth, fifth, and sixth atomic channels can be coplanar.

In any of the embodiments described herein, the first substrate can comprise a first side and a second side, and the first, second, third, and fourth atomic channels can be disposed in the first side of the first substrate. The system can further comprise a second substrate positioned adjacent to the first side of the first substrate, the second substrate capping the first, second, third, and fourth atomic channels.

In any of the embodiments described herein, the second substrate can comprise a first side and a second side, the first side positioned adjacent to the first substrate. The second substrate can comprise a fifth atomic channel disposed in the second substrate. The second substrate can further comprise a sixth atomic channel disposed in the second substrate and colinear with the fifth atomic channel. The second substrate can further comprise a third gap disposed between the fifth and sixth atomic channels. The fifth and sixth atomic channels can be coplanar.

In any of the embodiments described herein, the first and third atomic channels can be parallel along the substrate, and the second and fourth atomic channels can be parallel along the substrate.

In any of the embodiments described herein, the first atomic channel can have a first end proximate the atom source and a second end proximate the first gap. The second atomic channel can have a first end proximate the first gap and a second end distal to the first gap. The third atomic channel can have a first end proximate the atom source and a second end proximate the second gap. The fourth atomic channel can have a first end proximate the second gap and a second end distal to the second gap. A first distance between the first ends of the first and third atomic channels can be greater than a second distance between the second ends of the second and fourth atomic channels.

In any of the embodiments described herein, the first and third atomic channels can be parallel along the substrate, and the fifth atomic channel can be non-parallel to the first and third atomic channels.

In any of the embodiments described herein, the atom source can be proximate the first atomic channel. The system can further comprise a microelectromechanical system device disposed proximate the second atomic channel. The microelectromechanical system can be configured to receive atoms from the second atomic channel.

In any of the embodiments described herein, the atom source can be proximate the first and third atomic channels. The system can further comprise a microelectromechanical system device disposed proximate the second and fourth atomic channels. The microelectromechanical system device can be configured to receive atoms from the second and fourth atomic channels.

In any of the embodiments described herein, the microelectromechanical system device can be disposed on the first substrate.

In any of the embodiments described herein, the first, second, third, and fourth atomic channels can comprise a length and a width. The length of the atomic channels can be from 50 μm to 10 mm, and the width of the atomic channels can be from 50 nm to 300 μm.

In any of the embodiments described herein, the atom source can comprise alkaline or alkaline earth atoms. The atom source can, responsive to heat, emit the plurality of atoms.

In any of the embodiments described herein, the first substrate can comprise at least one of silicon carbide, aluminum nitride, polycrystalline silicon carbide, polycrystalline silicon, monocrystalline silicon, diamond, a metallic substrate, or fused quartz.

Another exemplary embodiment of the present invention provides a method. The method can comprise providing a substrate. The method can comprise etching a first atomic channel into the substrate. The method can comprise etching a second atomic channel into the substrate and in the same plane as the first atomic channel. The method can comprise capping the first and second atomic channels with a capping wafer. The method can comprise providing an atom source configured to emit a plurality of atoms to pass through the first and second atomic channels.

In any of the embodiments described herein, the method can comprise etching a third atomic channel into the substrate and in the same plane as the first and second atomic channels.

In any of the embodiments described herein, etching a third atomic channel into the substrate, the third atomic channel etched colinear with the first atomic channel. The method can comprise etching a fourth atomic channel into the substrate, the fourth atomic channel etched colinear with the second atomic channel. A first gap can be disposed between the first and third atomic channel, and a second gap can be disposed between the second and fourth atomic channel.

In any of the embodiments described herein, the first atomic channel and the second atomic channel comprise a length and a width. The length of the first and second atomic channels can be from 50 μm to 10 mm, and the width of the first and second atomic channels can be from 50 nm to 300 μm.

In any of the embodiments described herein, the atom source can comprise alkaline or alkaline earth atoms. The atom source can, responsive to heat, emit the plurality of atoms. The method can further include heating the atom source to emit atoms to pass through the first and second atomic channels.

In any of the embodiments described herein, the method can comprise providing a microelectromechanical system device configured to receive at least a portion of the plurality of atoms from the first and second atomic channels.

In any of the embodiments described herein, the microelectromechanical system device can be disposed on the substrate.

In any of the embodiments described herein, the substrate can comprise at least one of silicon carbide, aluminum nitride, polycrystalline silicon carbide, polycrystalline silicon, monocrystalline silicon, diamond, a metallic substrate, or fused quartz.

These and other aspects of the present disclosure are described in the Detailed Description below and the accompanying figures. Other aspects and features of embodiments of the present disclosure will become apparent to those of ordinary skill in the art upon reviewing the following description of specific, example embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while example embodiments may be discussed below as device, system, or method embodiments, it is to be understood that such example embodiments can be implemented in various devices, systems, and methods of the present disclosure.

BRIEF DESCRIPTION OF THE FIGURES

Reference will now be made to the accompanying figures and diagrams, which are not necessarily drawn to scale, and wherein:

FIGS. 6A-6F depict an exemplary method of manufacturing an atomic beam collimator, in accordance with some embodiments of the present disclosure.

DETAILED DESCRIPTION

Figure 1:
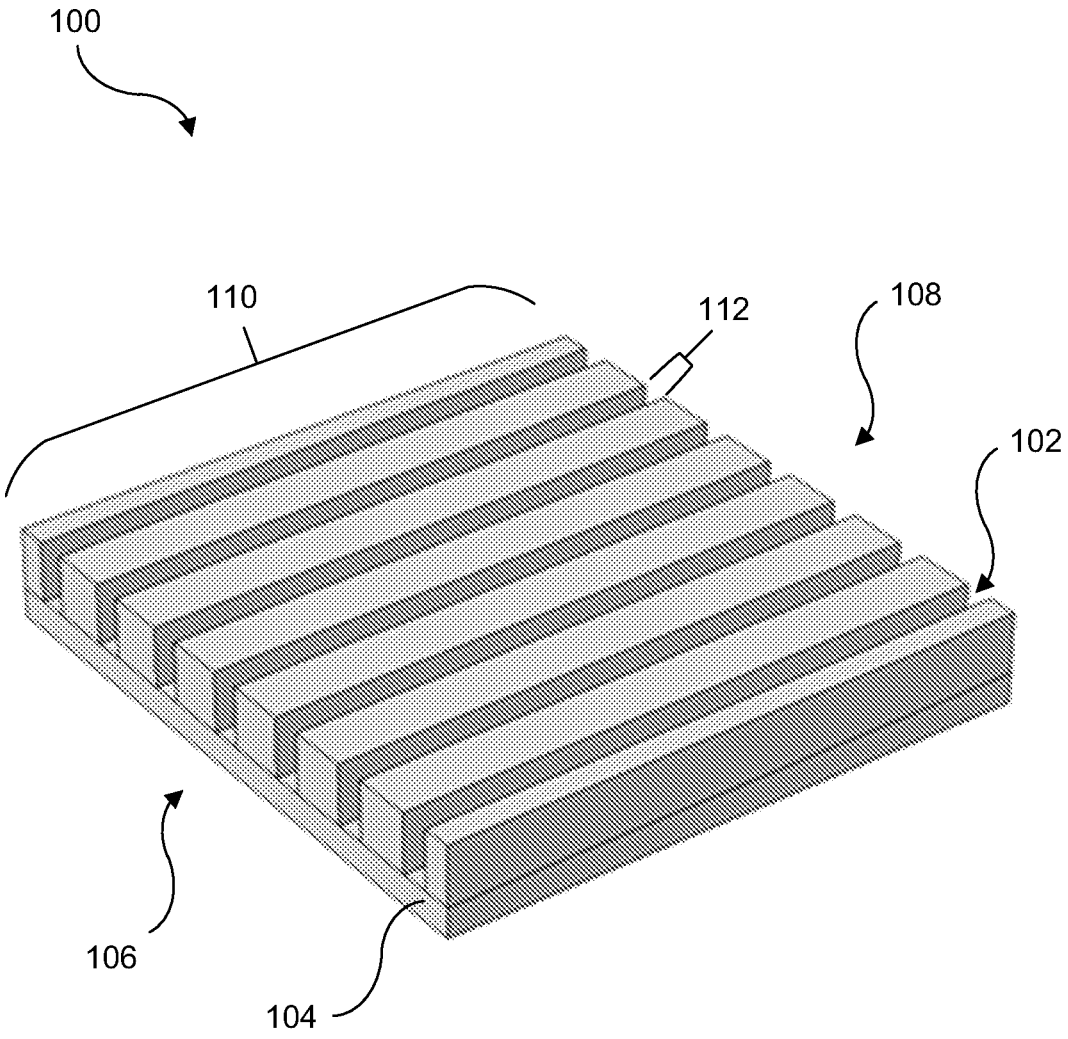
FIG. 1 is a perspective view of an exemplary atomic beam collimator having a plurality of atomic channels within a substrate, in accordance with some embodiments of the present disclosure.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

To facilitate an understanding of the principles and features of the disclosure, various illustrative embodiments are explained below. In particular, the presently disclosed subject matter is described in the context of miniaturized coplanar atomic beam collimators. The present disclosure, however, is not so limited and can be applicable in other contexts. For example, and not limitation, the systems and methods described herein may improve atomic collimation in any form factor. As will be described herein, certain embodiments of the present disclosure describe cascaded atomic collimation channels, which can be incorporated equally into small-form factor devices and large-scale collimation devices. Additionally, some embodiments described herein include hybrid atom-MEMS systems, yet the systems and methods may apply to other technologies, including, but not limited to, quantum technologies such as atom interferometers, clocks, Rydberg atoms, and/or hybrid atom-nanophotonic systems. The systems and methods may also enable controlled studies of atom-surface interactions at the nanometer scale. These embodiments are contemplated within the scope of the present disclosure. Accordingly, when the present disclosure is described in the context of miniaturized coplanar atomic beam collimators for any particular use or system, it will be understood that other embodiments can take the place of those referred to.

As described above, a problem with current atomic collimation devices is the mismatch in size between a several meter long highly collimated atomic beam apparatus and the nanometer length scales relevant for interactions with device surfaces, which makes alignment of source and target challenging. For example, if an atomic beam is to be used in precession sensing system including a microelectromechanical system (MEMS) device, such as an accelerometer or gyroscope, it can be exceedingly difficult to both align and capture the atomic beam at the small-form MEMS device.

The present disclosure describes systems and methods that can address the disconnect between large collimation systems and small-form atomic sensing/detecting devices. In some embodiments, the present disclosure describes (1) miniaturizing an atomic beam collimator, (2) improving the accuracy of atomic-sensing systems by improving the signal-to-noise ratio (SNR) of the atomic beam collimator, and (3) employing fabrication techniques that enable mass production of the atomic beam collimator. As will be described herein, certain embodiments of the presently disclosed systems and methods include an atomic beam collimator comprising atomic channels disposed within a substrate. These atomic channels can be coplanar in the substrate. In some embodiments, additional atomic channels can be disposed colinear with each other to provide a cascaded construct. Reference to a "cascaded" atomic beam collimator can be understood to mean a construct having a first atomic channel linearly-separated from a second atomic channel by a gap. In some embodiments, the gap region may suppress off-axis flux and, accordingly, increase the SNR of the system. In some embodiments, additional features and/or components may be included in a system, and these features and/or components can be provided as separate devices or provided on a common substrate with the atomic beam collimator.

Various devices and methods are disclosed for providing a miniaturized coplanar atomic beam collimator, and exemplary embodiments of the devices and methods will now be described with reference to the accompanying figures.

FIG. 1 depicts an exemplary atomic beam collimator 100 having a plurality of atomic channels 102 within a substrate 104, in accordance with some embodiments of the present disclosure. As can be seen in the figure, one or more atomic channels 102 can be disposed in the substrate 104 to allow an atom to pass from a first end 106 to the second end 108 of the atomic channels 102. Recent developments in micro- and nano-fabrication allow the atomic channels 102 to be manufactured in a coplanar construction within the substrate 104. An example, but not limitation, of these nano- and micro-processes include lithography, as will be described herein. In some embodiments, the atomic channels 102 may be provided in a small-scale, integrated device that may range from micrometers to millimeters in length and width.

It is contemplated that the substrate 104 may comprise silicon carbide, aluminum nitride, polycrystalline silicon carbide, polycrystalline silicon, monocrystalline silicon, diamond, fused quartz, or any other substrates, including metallic substrates, that may allow micro-fabrication of atomic channels 102. As described herein, microfabrication techniques such as photolithography, may help tailor and control the velocity distribution of an atomic beam passing through the atomic channels 102. Additionally, micro- and nano-fabrication techniques also allow the length, width, and depth of an atomic channel 102 to be customized. For example, an atomic channel 102 may have a length 110 of less than 10 mm (e.g., 50 μm to 10 mm), and an atomic channel 102 may have a width 112 of less than 300 μm (e.g., 50 nm to 300 μm). However, and as described herein, larger lengths 110 and widths 112 can be provided in the presently-described systems and methods, and a length 110 and width 112 can depend on the desired use of the atomic beam collimator 100. As shown in the figure, an atomic beam collimator 100 may comprise a plurality of atomic channels 102. Although the figure shows an embodiment having seven atomic channels 102, this is merely exemplary. It is contemplated that an atomic beam collimator 100 may comprise any number of atomic channels 102 depending on the desired attributes, which may include a desired number of atomic beams or desired device footprint.

In some embodiments, an atom source can be provided at the first end 106 of the atomic channels 102. The atom source can be provided as a separate device or can be integrated into the substrate 104. In the case that an atom source is provided within the substrate 104, some of the complexity associated with free space transport of atoms to the surface from a magnetooptical trap (MOT) or BEC can be eliminated. These embodiments may also improve accuracy of beam alignment with nano- and micro-scale features that may be down-channel from the atom source, thereby addressing the aligning and targeting limitations found with current, large collimator devices. In some embodiments, a MEMS device, including but not limited to an accelerometer and/or a gyroscope, may be positioned at the second end 108 of the atomic channels 102. The MEMS device can be provided as a separate device or can be integrated into a common substrate 104 with the atomic beam collimator 100.

Figure 2:
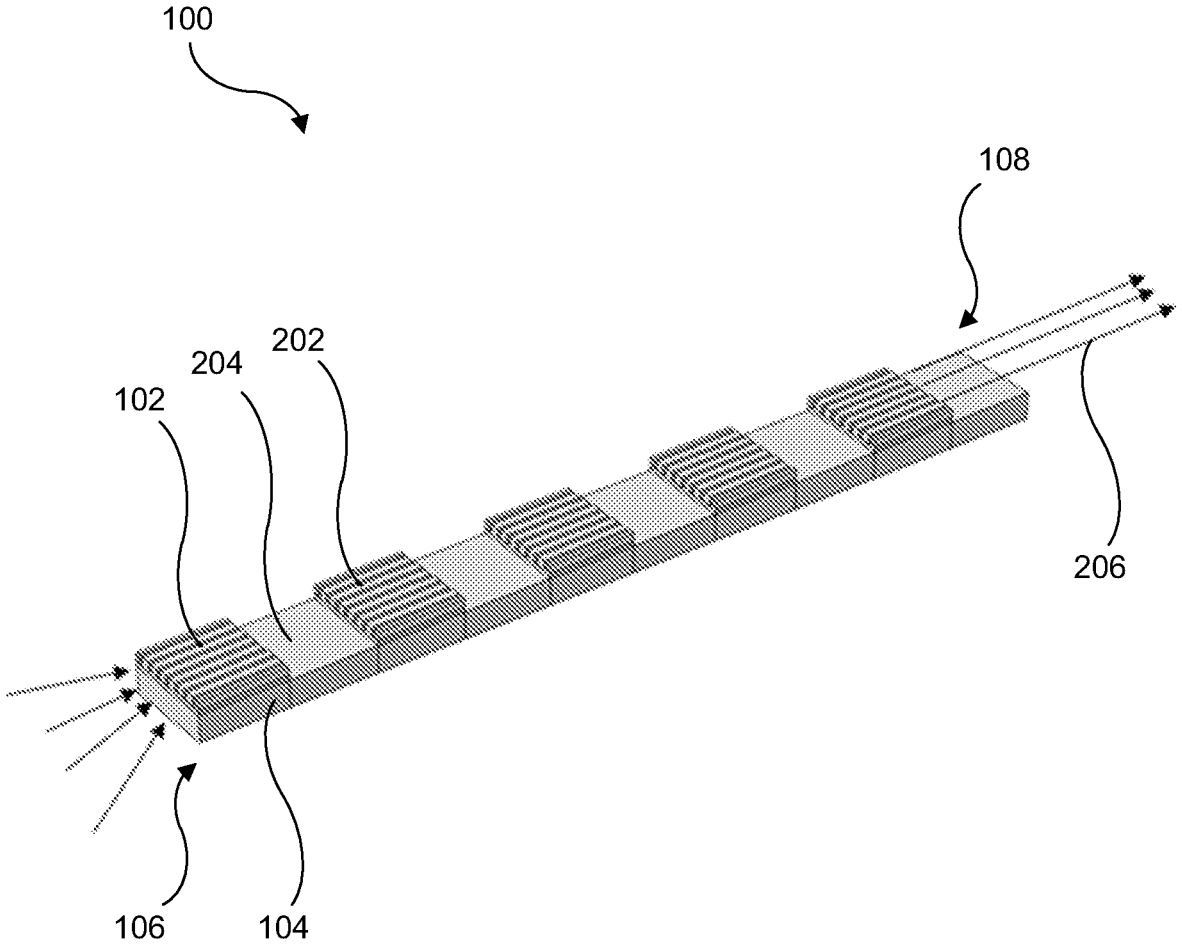
FIG. 2 is a perspective view of an exemplary atomic beam collimator having a plurality of atomic channels separated by gaps, in accordance with some embodiments of the present disclosure.

FIG. 2 depicts an exemplary atomic beam collimator 100 having a plurality of atomic channels 102,202 and gaps 204 within the substrate 104, in accordance with some embodiments of the present disclosure. In some embodiments, an atomic beam collimator 100 may have a first set of coplanar atomic channels 102 disposed within the substrate 104, a second set of coplanar atomic channels 202 disposed within the substrate 104, and a gap 204 disposed between the first and second set of atomic channels 102,202. Each channel in the first set of coplanar atomic channels 102 can be colinear with a corresponding channel in the second set of coplanar atomic channels 202. Such a construct provides the cascaded system of channels described herein. By cascading sets of atomic channels 102,202, the atomic beam 206 produced can have a greatly suppressed off-axis flux, as some off-axis atoms will become trapped in the gap 204 region. In some embodiments, an atomic beam collimator 100 may comprise two sets of atomic channels 102,202 separated by a single gap 204 region. In other embodiments, it is contemplated that that any number of atomic channels can be provided, each separated by a gap region. For example, FIG. 2 shows an embodiment having five atomic channel regions separated by four gap regions, which is in accordance with some embodiments. In some embodiments, the length of a gap 204 region may be approximately the same as the length of an atomic channel 102,202, as described herein. The size of the gap 204 region, however, is not required to be the same length as an atomic channel 102,202, and in some embodiments the gap 204 may be shorter or longer than the length of an atomic channel 102,202.

Figure 3A:
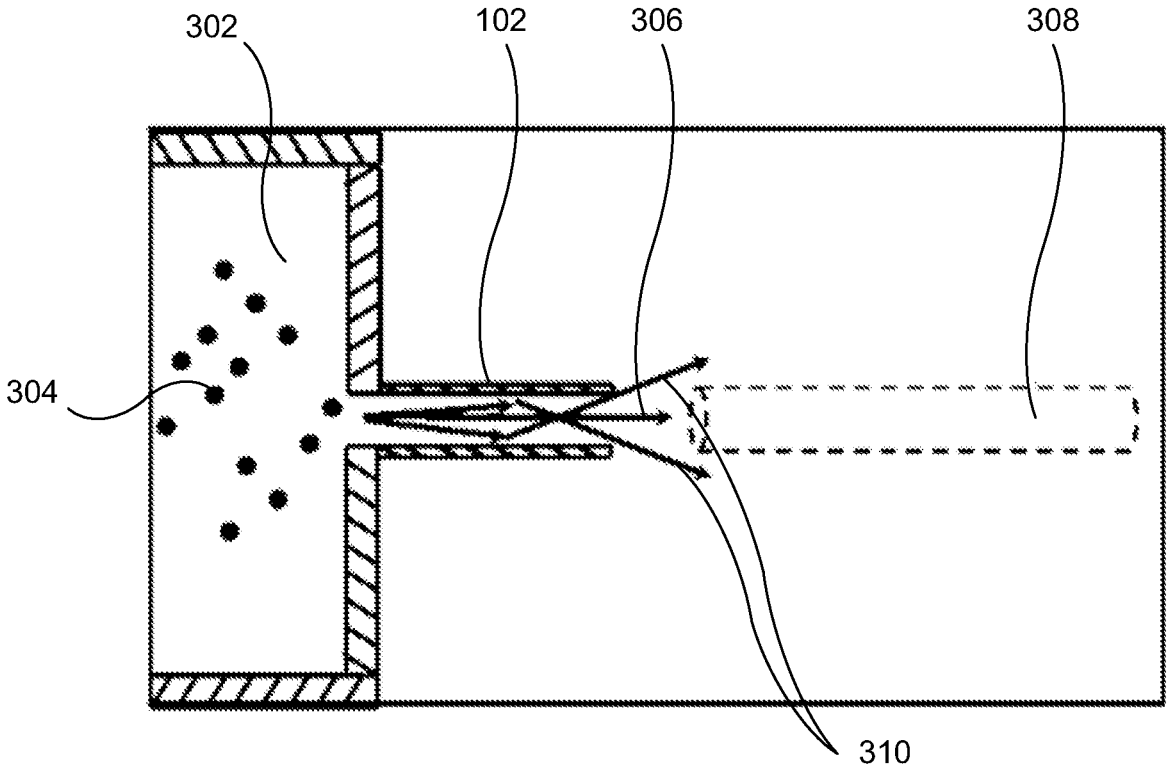
FIG. 3A depicts an atomic beam collimator having a single channel, in accordance with some embodiments of the present disclosure.
Figure 3B:
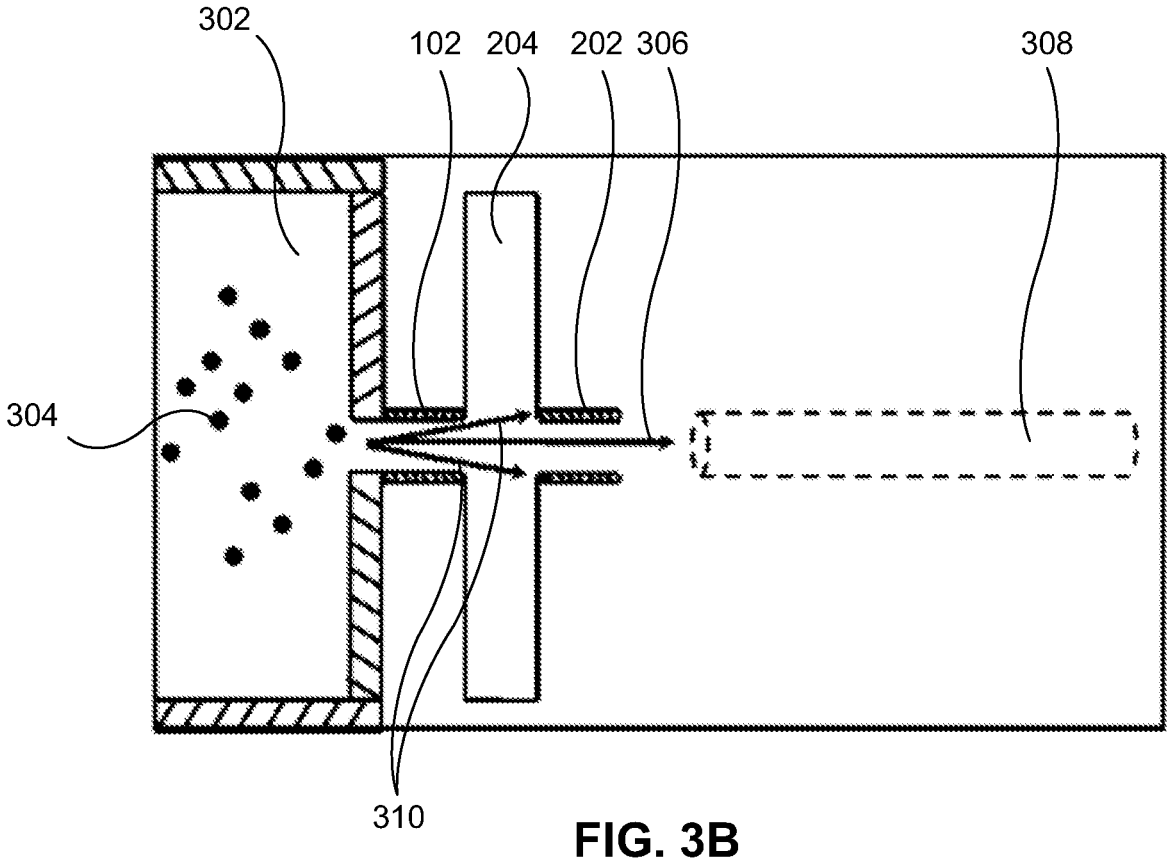
FIG. 3B depicts an atomic beam collimator with cascaded channels, in accordance with some embodiments of the present disclosure.

FIG. 3A depicts an atomic beam collimator 100 having a single channel, and FIG. 3B depicts an atomic beam collimator 100 with cascaded channels. The physical package of an atomic-beam sensor, such as a clock or gyroscope, ordinarily consists of two parts: an atom source 302 region that emits atoms 304 in the form of a collimated beam 306 along the forward axis, and a sensing region 308, where the collimated beam 306 is processed to produce the sensor output. As shown in FIG. 3A, an embodiment having a single, un-cascaded atomic channel 102 poses the risk of producing off-flux atoms 310 that exit the system before entering the sensing region 308. These atoms may constitute an unwanted background that degrades the system signal-to-noise ratio (SNR). To decrease the number of off-flux atoms 310, the divergence angle HWHM (half-width at half-maximum) can be limited by increasing the length of the atomic channel 102 and/or decreasing the width of the atomic channel 102. This process is achievable with the microfabrication techniques described herein.

FIG. 3B depicts an alternative method of decreasing the off-flux atoms, namely by cascading a series of first atomic channels 102 and second atomic channels 202, separated by a gap 204 region. Off-flux atoms 310 that enter a gap 204 region may be more likely to leave the system immediately rather than continuing to a subsequent atomic channel 202. If x is the relative likelihood of exiting versus propagating through a subsequent atomic channel 202, then $x>1$ can be achieved by having a large enough aspect ratio for the individual atomic channels, for example, and not limitation, 10:1. Thus if $W^0$ is the probability for an atom to pass through a single channel of length L, then a simple geometrical argument shows that the probability W to pass through a cascade of n smaller atomic channels of length $l=L/(2n-1)$ is reduced by a factor $W/W_0=(2n-1)/x^{n-1}$. Indeed, experimental results on an exemplary device having three cascaded atomic channels (n=3) produced a substantial degree of suppression $W/W_0=0.024\approx 1/40$. In some embodiments, greater suppression can be achieved by engineering a greater degree of vapor isolation, and a theoretical limit for an estimated value of x~50 is approximately $10^{-3}$. In some embodiments, this isolation may be achieved through direct, on-substrate 104 pumping methods. Additionally, providing a cascaded series of atomic channels 102,202 may provide a greater SNR without increasing the overall length of the atomic beam collimator 100.

In some embodiments of a cascaded atomic beam collimator 100, the alignment of a series first atomic channels 102 may be colinear with the second atomic channels 202. A colinear construct allows a collimated beam 306 to continue from the first atomic channel 102 to the second atomic channel 202 without the risk of misalignment prohibiting the on-flux beam 306 from passing to the subsequent channel. A colinear construct is prohibitively difficult for conventional collimator devices. As described herein, the three-dimensional bundle of collimator tubes, each ordinarily with a length of several meters, in conventional devices are not conducive to exact channel-alignment. Unlike conventional machining and/or drawing, however, the use of micro- and nano-fabrication methods, such as photolithography, to define the atomic channels 102,202 allows a great deal of customization and control with high spatial resolution less than 1 μm. For example, downstream alignment of source and target becomes is improved with the presently described systems, providing misalignments less than $10^{-5}$ radians over a 10 cm substrate 104 length. This is comparable to the most sensitive atomic beam interferometers that require several meters of length to separate the two interferometer arms.

Figure 4:
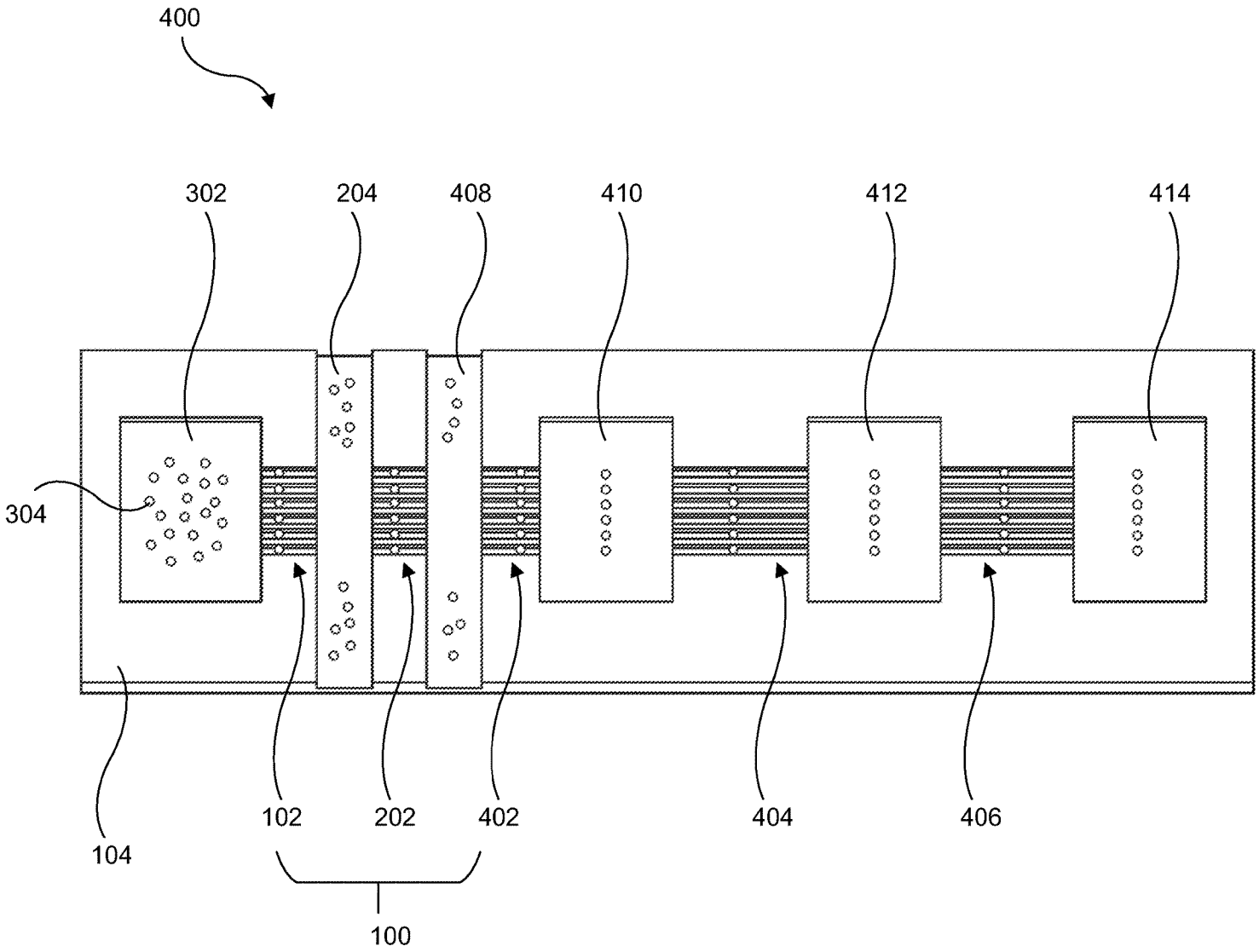
FIG. 4 is a top view of an exemplary atomic beam collimator system, according to some embodiments of the present disclosure.

FIG. 4 is a top view of an exemplary atomic beam collimator system 400, according to some embodiments of the present disclosure. In some embodiments, atoms 304 may propagate from an atom source 302 into a planar atomic beam collimator having atomic channels 102,202,402,404, 406 disposed in a substrate 104. The atom source 302 may be a high density atomic vapor comprising an effusive emission source. The atom source 302 may be a separate device connected to and/or adjacent to a first atomic channel 102. In some embodiments, the atom source 302 region may be disposed within a common substrate 104 with the atomic channels 102,202,402,404,406. In an exemplary embodiment, the atoms 304 may be injected into the substrate 104 to create the atom source 302. In some embodiments, the atom source 302 may comprise rubidium atoms, cesium atoms, or other alkaline or alkaline earth atoms.

In some embodiments, the system 400 may comprise additional operations or components. For example, and not limitation, in some embodiments an atomic beam collimator system 400 may comprise a laser deceleration and/or cooling region 410. In some embodiments, an atomic beam collimator system 400 may comprise a sensing region 412 for atom interferometry or other sensing protocols using guided atoms 304. The cooling region 410 and/or sensing region 412 can be separate devices in communication with the collimator system 400 by atomic channels 402,404, or the regions 410,412 can be integrated into a common substrate 104 with the other operations or components, such as the atom source 302, gaps 204,408, or any other operation or component.

In some embodiments, an atomic beam collimator system 400 may comprise a detection region 414. As described herein, the detection region 414 may include atomic beam clocks, atom beam interferometer based gyroscopes, accelerometers, or other MEMS devices that may detect and/or benefit from a collimated beams of atoms 304. In some embodiments, the detection region 414 can be a separate device in communication with the system 400 via atomic channels 406. In some embodiments, an atomic beam collimator 100 may be disposed on a common substrate 104 with the detection region 414 (e.g., MEMS device). An integrated atomic beam collimator system 400 having a detection region 414 and an atomic beam collimator 100 on a single shared substrate 104 may enable mass fabrication of atomic devices. Currently, an atomic beam clock, gyroscope, or other MEMS device may consist of separately machined and hand assembled/aligned components. The additional components may include, but are not limited to, a) heaters and temperature controls, b) optical waveguides for addressing atoms, c) magnetic field controls, and/or d) signal processing components for the sensor outputs. With the presently-described systems and methods, it is contemplated that these components and any additional electronic components can be integrated into a single, shared substrate with the atomic beam collimator 100, providing an opportunity for large-scale, parallel production of integrated atomic beam collimator systems 400.

Figure 5A:
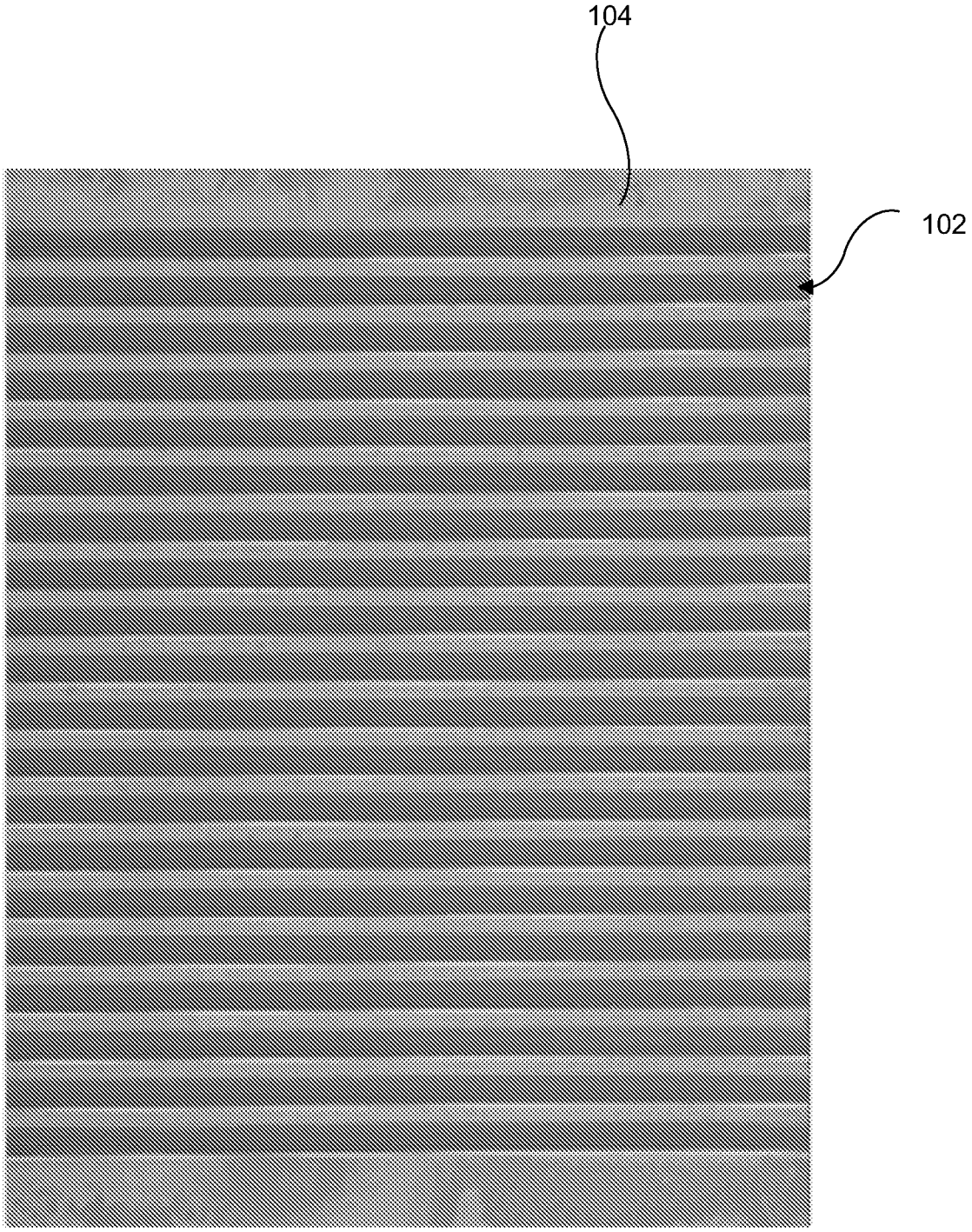
FIG. 5A is a scanning electron micrograph of parallel atomic channels, in accordance with some embodiments of the present disclosure.
Figure 5B:
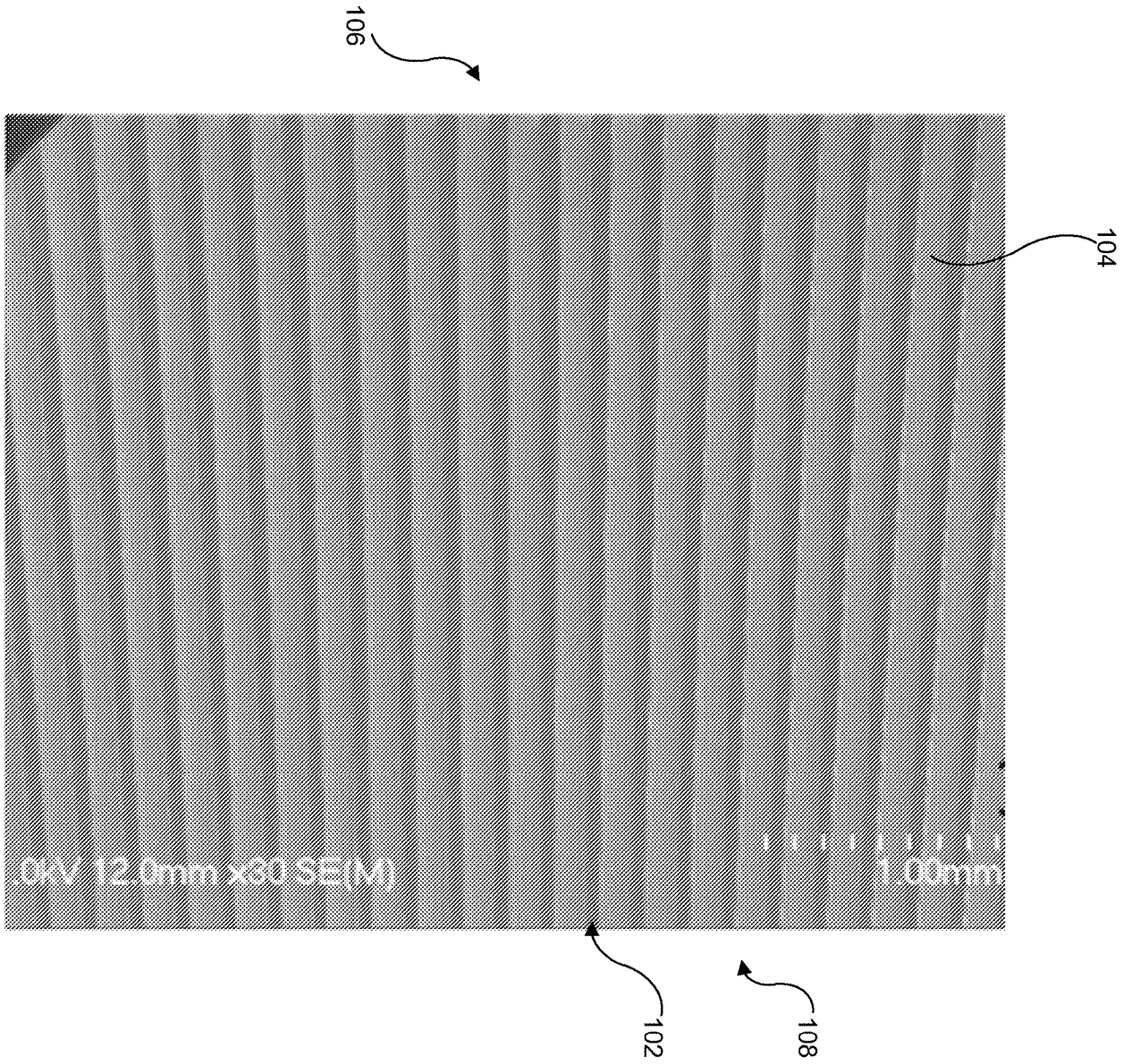
FIG. 5B is a scanning electron micrograph of converging atomic channels, in accordance with some embodiments of the present disclosure.
Figure 5C:
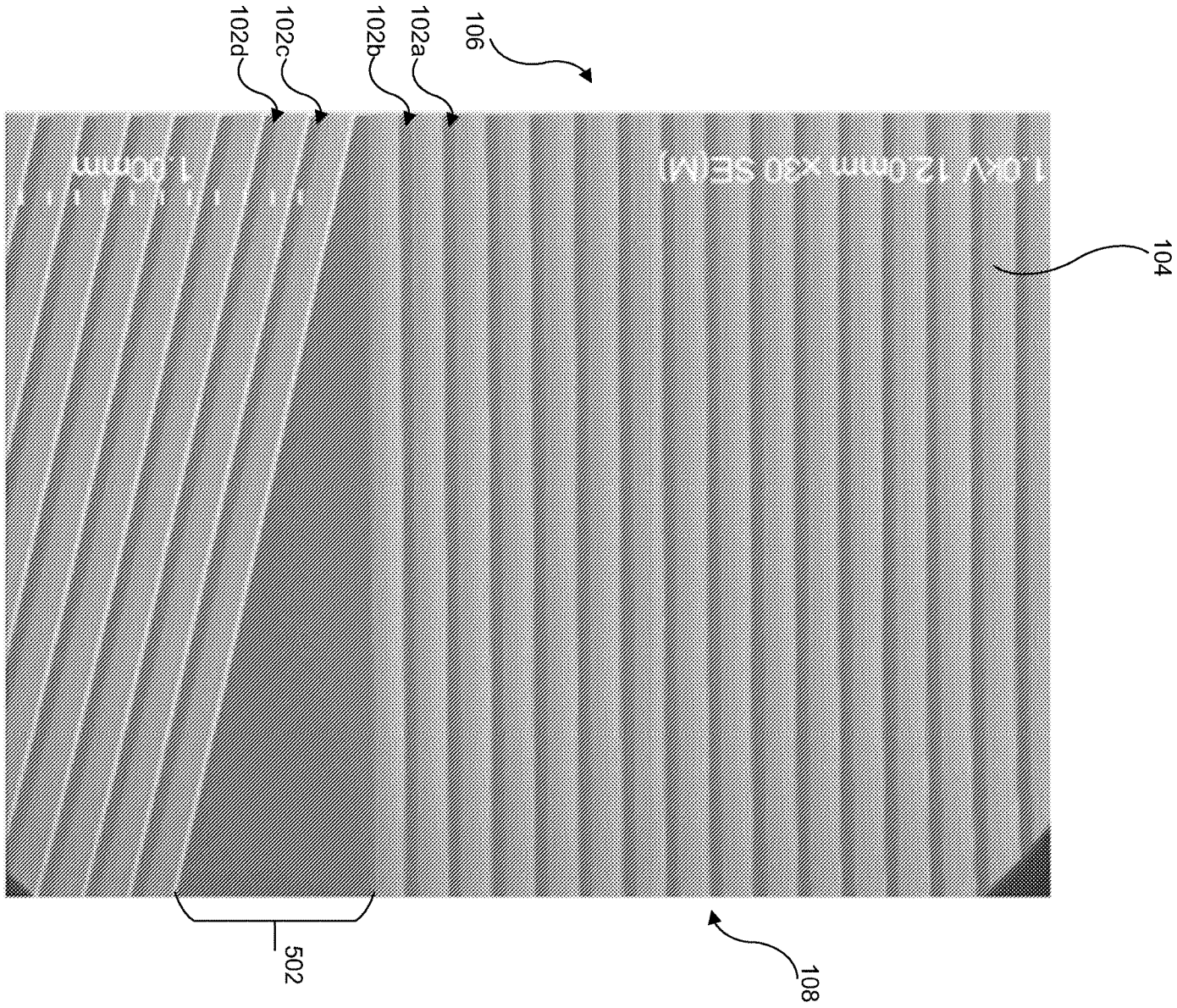
FIG. 5C is a scanning electron micrograph of atomic channels creating propagating collimated beams at a relative angle, in accordance with some embodiments of the present disclosure.

FIGS. 5A-5C depict various atomic channel 102 trajectories that may be disposed in a substrate 104. FIG. 5A is a scanning electron micrograph of parallel atomic channels 102, which is in accordance with some embodiments. As described herein, the planar atomic channels 102 can be fabricated in a substrate 104 with micro- and nano-fabrication techniques. These techniques allow a variety of planar trajectories for the atomic channels 102. In one embodiment, the atomic channels 102 may be parallel and produce parallel collimated beams.

FIG. 5B is a scanning electron micrograph of atomic channels 102 wherein a first distance between atomic channels 102 at the first end 106 is greater than a second distance between atomic channels 102 at the second end 108, which is in accordance with some embodiments. In other words, in the embodiment shown in FIG. 5B, the atomic channels 102 are in a converging trajectory. For example, if an atom source 302 (not shown in the figure) is positioned proximate the first end 106 of the atomic channels 102, then the atomic channels 102 can produce a focused beam of collimated atoms at a second end 108 of the atomic channels 102. It is also contemplated that the atomic channels 102 can also diverge from a first end 106 to a second end 108.

FIG. 5C is a scanning electron micrograph of atomic channels 102*a,b,c,d* creating propagating collimated beams at a relative angle 502, which is in accordance with some embodiments. In some embodiments, a first set of atomic channels (i.e., atomic channels 102*a,b*) can be formed parallel to each other. A second set of atomic channels (i.e., atomic channels 102*c,d*) can be formed parallel to each other. The first set of atomic channels 102*a,b* can be formed at a relative angle 502 from the second set of atomic channels 102*c,d* so as to create two diverging collimated beams. In some embodiments, this design may allow a first MEMS device to be placed at a second end 108 of the first set of atomic channels 102*a,b* and a second MEMS device to be placed at a second end 108 of the second set of atomic channels 102*c,d*. The first and second MEMS device could, therefore, share a common atom source disposed proximate the first end 106 of the atomic channels 102*a,b,c,d*. The relative angle of divergence for the device shown in FIG. 5C is 12 degrees, which is in accordance with some embodiments.

FIGS. 6A-6F depict an exemplary manufacturing method for fabricating an atomic beam collimator, in accordance with some embodiments of the present disclosure. As described herein, various micro- and nano-fabrication techniques could be employed to create an atomic beam collimator 100. In some embodiments, the atomic beam collimator 100 can be created by either etching relief regions (atomic channels 102) into a base substrate 104 or by cutting such reliefs into a capping substrate 602. In some embodiments, two silicon wafers (a base substrate 104 (or wafer) and a capping substrate 602 (or wafer)) can be bonded together to form an enclosed structure. A layer of oxide can be grown on a base silicon wafer, as shown in FIG. 6A. A layer of photoresist can be patterned and the oxide can be etched in an RIE process, which can form the mask for the atomic channels, as shown in FIG. 6B. After the oxide etching, the atomic channels can be etched using the Bosch DRIE process up to the depth of the atomic collimators, as shown in FIG. 6C. In some embodiments, the wafer than be cleaned and the remaining oxide can be etched away in 49% HF solution to form the completed base wafer, as shown in FIG. 6D. In some embodiments, gold can be evaporated on the capping wafer, as shown in FIG. 6E. The two wafers can then be bonded together using a Si—Au eutectic bond at 450° C. The different dies can be diced across the wafer according to the length of the atomic channels, to provide a completely sealed structure, with access to the two ends of the atomic channels, as shown in FIG. 6F. In some embodiments, a cascaded topology can be created by partially dicing through the bonded wafers, thus breaking the sealed structure at the gap regions.

In some embodiments, the process can be repeated on the capping substrate 602. In other words, multiple layers of planar atomic channels can be created by providing a base substrate 104 with atomic channels 102, a capping substrate 602 with atomic channels 102, and another capping substrate, to create stacked layers of atomic channels 102, each sealed with a subsequent capping substrate. Any number of stacked substrates having planar atomic channels is contemplated and will depend on the desired attributes of the atomic collimator device or system. In some embodiments, each layer of atomic channels 102 can have similarly-shaped atomic trajectories (as shown in FIGS. 5A-5C). It is also contemplated that a first layer of planar atomic channels can have a first trajectory and a second layer of atomic channels can have a second trajectory, as a geometry of a first layer will not constrain the geometry of a second layer.

Figure 7:
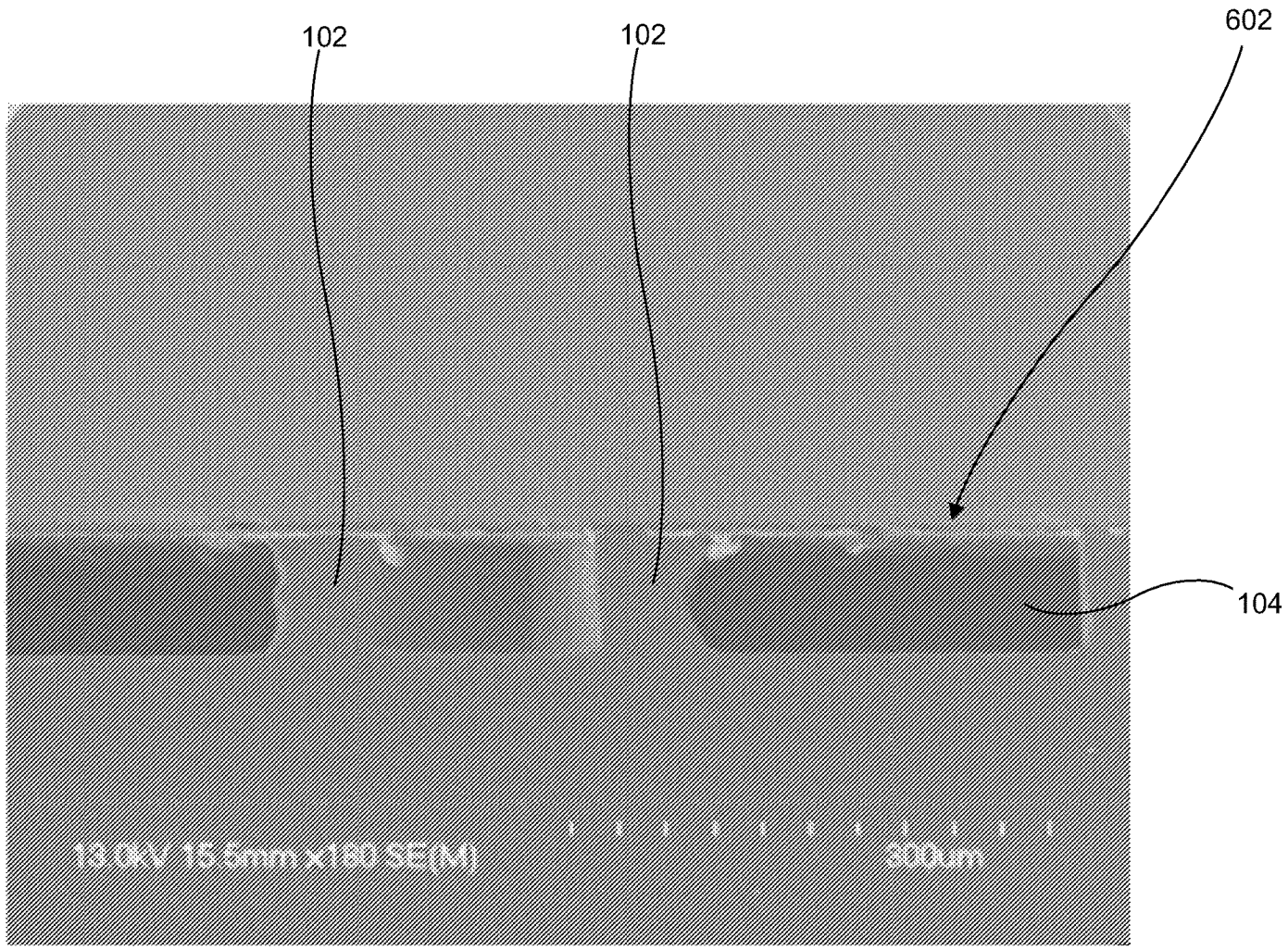
FIG. 7 is a scanning electron micrograph of a cross section of an exemplary device testing the fabrication and bonding techniques described in FIGS. 6A-6F.

FIG. 7 is a scanning electron micrograph of a cross section of an exemplary device testing the fabrication and bonding techniques described for FIGS. 6A-6F. The micrograph shows two atomic channels 102 disposed in a substrate 104 and sealed with a capping substrate 602.

Experimental Section

Figure 8A:
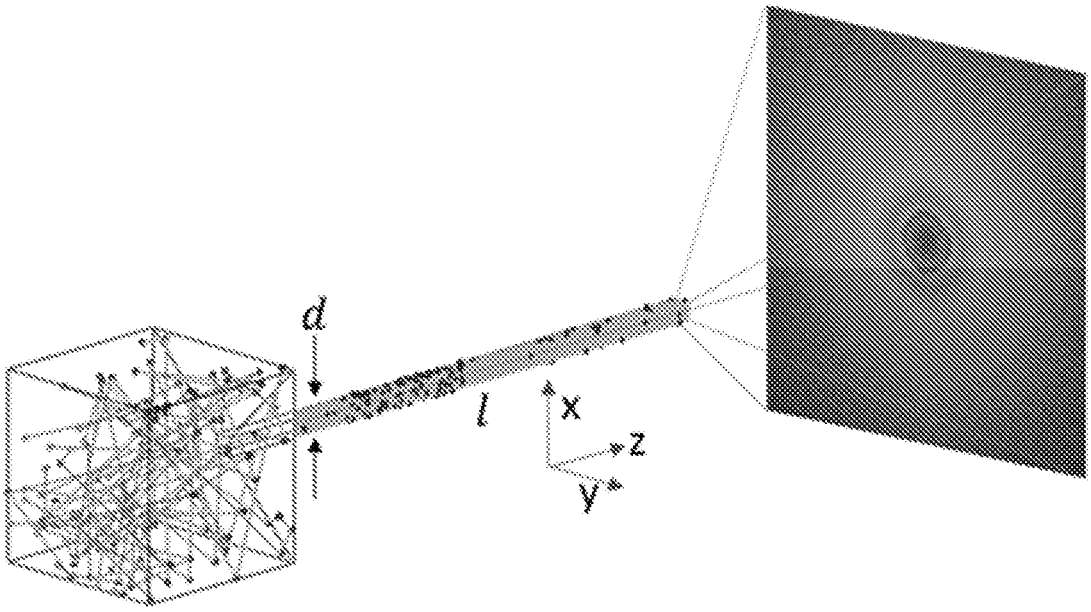
FIG. 8A depicts a Monte-Carlo simulation of a single-channel collimator, in accordance with some embodiments of the present disclosure.

The following section presents results from testing exemplary embodiments of the devices described herein. FIG. 8A depicts a Monte-Carlo simulation of a single-channel collimator with l/d=30 using a Molflow+ package which operates in the molecular flow regime. The two-dimensional image at the right depicts the output angular flux distribution. The image shows a sharp peak near $\theta=0$ (the center of the two-dimensional image), with a half-width of $\theta_{1/2}$ that is approximately 1.8 deg. However, the image shows that a significant, low level flux is emitted into large angles, and therefore the width of the central peak does not describe the angular distribution very accurately. In fact, about 99% of the emitted flux is in this broad background with $\theta>\theta_{1/2}$. Again, one way to improve the background of this single-channel construct is to increase the length l of the atomic channel.

Figure 8B:
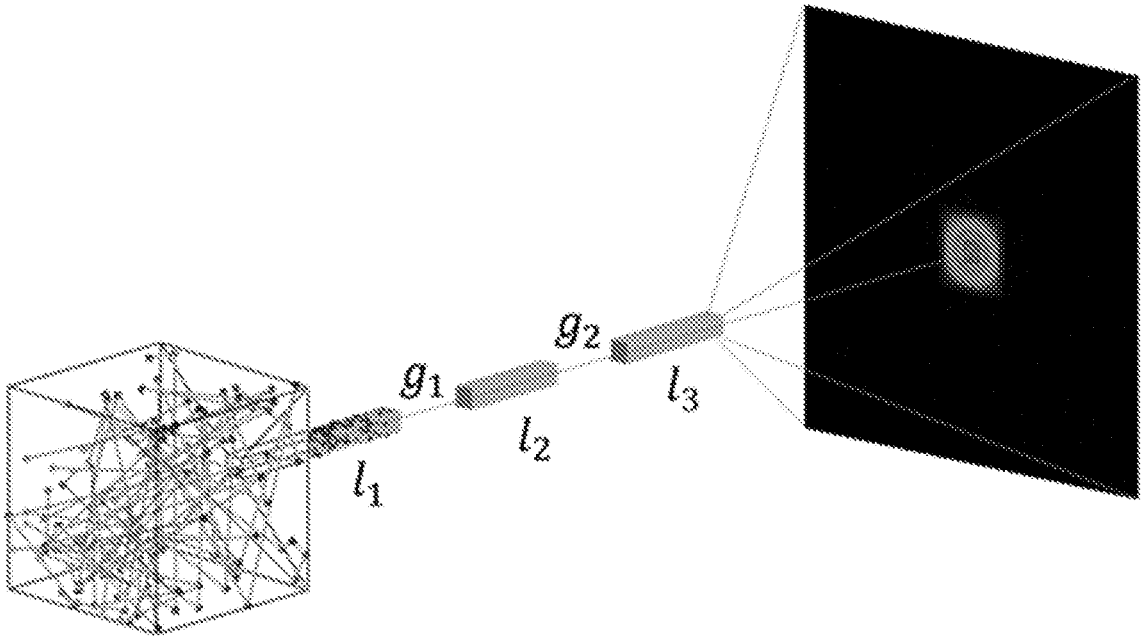
FIG. 8B depicts a Monte-Carlo simulation of a cascaded atomic collimator with three channels and two gap regions, in accordance with some embodiments of the present disclosure.

Another method of increasing the SNR of an atomic collimator is to provide a series of cascaded atomic channels, as described herein. FIG. 8B depicts a Monte-Carlo simulation of a cascaded collimator with three tubes (atomic channels) and two gap regions. As described above, the cascaded geometry of an atomic collimator can decrease the probability of an off-flux atom exiting the collimator by a factor of a factor $W/W_0=(2n-1)/x^{n-1}$. Referring to FIG. 8B, a collimator with three channels (n=3) can produce a degree of separation $W/W_0=0.024\approx1/40$. This number was reflected in the Monte-Carlo simulations of the embodiment shown in FIG. 8B.

Device Fabrication

To demonstrate the capabilities of a straight and cascaded collimator device, two exemplary atomic collimators were prepared. The first collimator was a straight (i.e., the embodiment shown in FIG. 8A) collimator designed according to the exemplary manufacturing process described above in the discussion for FIGS. 6A-6F. The atomic channel dimensions were 100 μm×100 μm×3 mm (h×w×l), with 50 μm of substrate between each atomic channel. The second collimator was made in a similar process but comprised three cascaded segments (i.e., the embodiment shown in FIG. 8B). To create the cascaded collimator, the silicon wafers were partially diced through the bonded wafers in two places, resulting in channel lengths of $l_1$, $l_2$, $l_3$=690, 610, 660 μm, while the two gap-region widths were $g_1$, $g_2$=510, 500 μm. For the atomic source, a Rb oven was provided comprising a pinched copper tube (⅜ inch OD, 6 inch length) containing a 200 mg Rb ampoule. The silicon chip collimators were glued into a slit at the center of a separately heated nozzle holding using thermally conductive epoxy. For the cascaded collimator, a piece of shim stock placed directly at the exit face of the silicon chip was used to separate the released off-axis vapor from the forward atom beam. The oven temperature was recorded using thermistors and controlled using external heaters of a standard variety.

Measurement Protocols

Figure 9A:
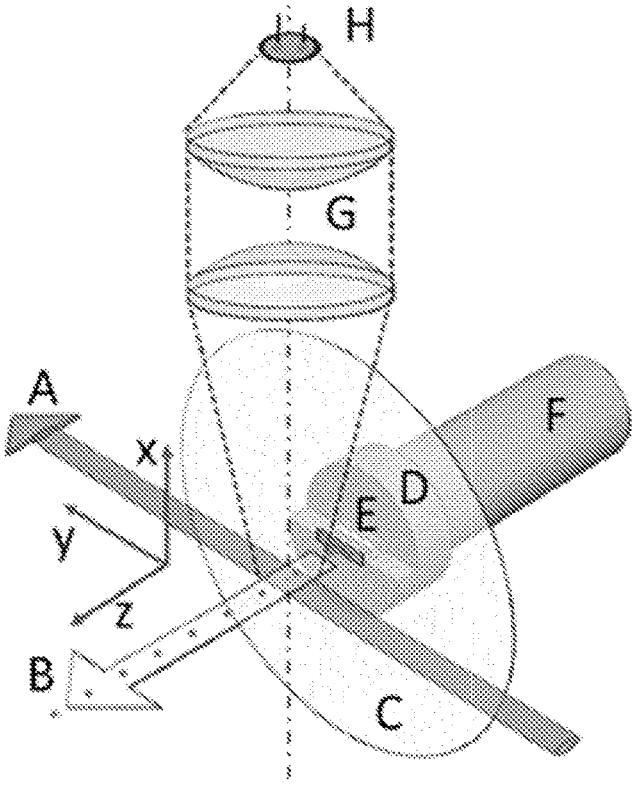
FIG. 9A is an exemplary setup for producing atomic beams in an experiment.
Figure 9B:
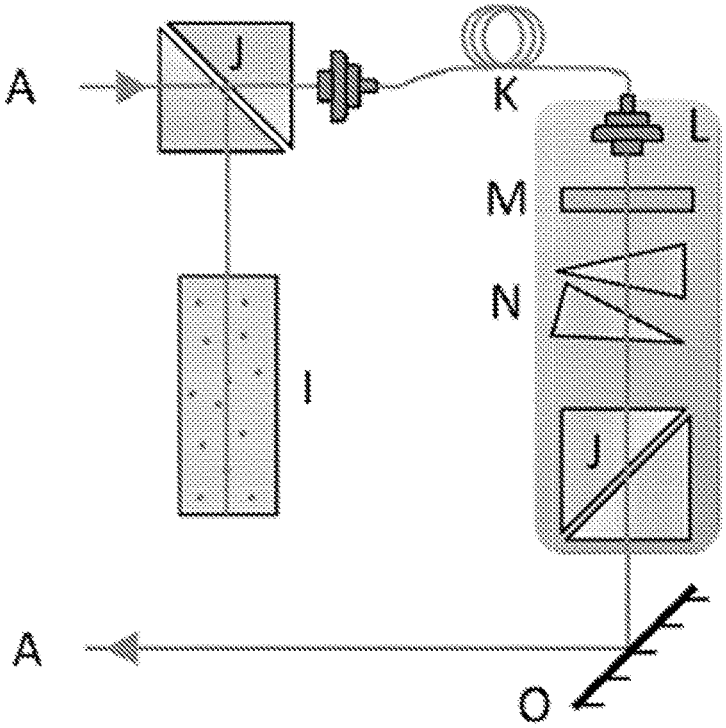
FIG. 9B is an exemplary setup for controlling laser frequency and beam control in an experiment.

Doppler-sensitive laser spectroscopy of atomic beams on the straight and cascaded collimators were performed using a free-running diode laser scanned at a frequency of 5 Hz, with scan range ≤1 GHz. The fluorescence induced was recorded by a probe laser exciting $^{87}$Rb D2 resonance near $\lambda$=780 nm and propagating perpendicular to the atomic beam. Thus, Doppler shifts due to the Maxwell-Boltzmann distribution of longitudinal velocities could be eliminated. Several hyperfine resonances between the $5S_{1/2}$, F=2 ground state and the $5P_{3/2}$, F'=1,2,3 levels were detected as a function of the probe frequency. The width of each peak was Doppler broadened due to the transverse velocity distribution of the emitted atoms, and the fluorescence intensity measured this distribution. FIG. 9A depicts an exemplary setup for producing atomic beams, and FIG. 9B is an exemplary setup for controlling laser frequency and beam control. In FIGS. 9A-9B, the reference numbers refer to the following: A=laser beam; B=atom beam; C=shim stock; D=nozzle holder; E=silicon chip collimator; F=copper tube; G=plano-convex lenses, f=75 mm; H=photodiode; I=rubidium cell for saturation spectroscopy; J=polarizing beamsplitter; K=optical fiber and fiber coupler; L=translational stage; M=λ/2 waveplate; N=prism pair; and O=mirror.

The probe light was transferred from an optical table for the laser frequency control to a table for the atomic beam experiment through a single mode polarization-maintaining fiber. The fiber output, a half-wave plate, a prism pair, and a polarizing beamsplitter were coaxially aligned and mounted together onto a single vertical translation mount, so that the laser beam could be precisely scanned in the vertical dimension through adjusting the screw for the base plate. Light coming out from the fiber is horizontally expanded by the prism pair, p-polarized by the beamsplitter, and then reflected by a broadband dielectric mirror, after which it enters the vacuum region through a standard low-iron glass viewing window (6 inches×6 inches). Two cage rods along the laser beam mount the mirror and allow the mirror to move along the laser beam without changing the laser-atom beam orthogonality. Therefore, a sequence of camera images along the atom beam could be captured by scanning the mirror position without introducing unwanted Doppler shift.

Atomic fluorescence from the laser spot was collected by two f=75 mm 2 inch diameter plano-convex lenses and then focused onto a photodiode covered with a 780 nm interference filter to block room light. The distance between the center of the laser beam and the nozzle exit could be determined by replacing the photodiode with a camera and imaging both the fluorescence spot and the edge (with well-defined 5 mm width) of the silicon chip. Through maximizing the peak height and minimizing the full width half maximum of the fluorescence spectrum, an orthogonal crossing interaction region can be achieved. The fluorescence was collected from a location 6 mm away from the nozzle exit in order to ensure the photodiode detects atoms coming from all angles. The Gaussian radius ($1/e^2$) of the laser beam measured at the interaction is 1.4 mm and 0.5 mm for the horizontal and vertical dimension, respectively. An optical case system located above the chamber window mounts the two lenses and the photodiode along the vertical axis of the fluorescence spot when the laser frequency is on resonance.

The photocurrent was amplified by a preamplifier (Gain either $10^8$ or $10^9$ V/A) realizing a rise time of 0.04 or 0.24 ms, respectively. No circuit delay broadening is expected, and this was verified by monitoring the width of the fluorescence spectrum while varying the scan frequency of the laser from 5 Hz to 100 Hz at Gain=$10^8$ V/A. Both the saturated spectroscopy from the rubidium reference cell for the frequency calibration and the fluorescence spectrum from the atomic beam were recorded and averaged over 64 traces by an oscilloscope. Background scans were taken 9.5 mm directly below the atomic beam in order to subtract off fluorescence from a weak Rb vapor in the chamber.

Results

Figure 10A:
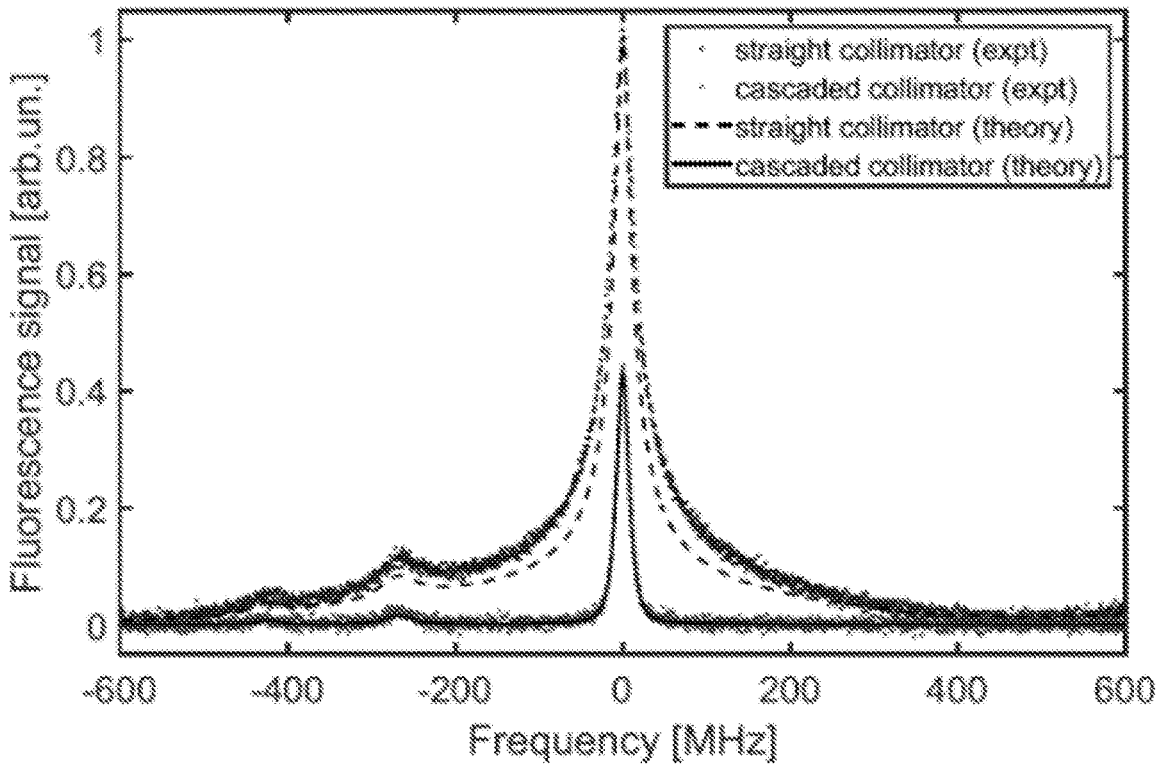
FIG. 10A is a graph of the measured atomic fluorescence spectra versus excitation laser frequency on exemplary straight and cascaded collimators.

To demonstrate the effect of cascading the atomic channels, Doppler sensitive laser spectroscopy was used on the Rb D2 line. This technique can help provide the transverse velocity ($\upsilon_\perp$) distribution of the atomic beams generated by the straight and cascaded collimators. From this data, for small angles, the angular distribution can be inferred through the transformation $\sin\theta=\upsilon_\perp/\bar{\upsilon}$, where $\bar{\upsilon}\approx 300$ m/s is the mean velocity of $^{87}$Rb atoms when over temperature equals 100° C. FIG. 10A is a graph of the measured atomic fluorescence spectra versus excitation laser frequency for the straight and cascaded collimators tested. FIG. 10A shows the traverse Doppler distribution of an atomic beam from each collimator. Multiple hyperfine resonances between the $^{87}$Rb $5S_{1/2}$, F=2 ground state and the $5P_{3/2}$, F'=1,2,3 levels appear as narrow peaks as a function of the probe frequency. The strongest such peak is the F'=3 level, centered at zero frequency off-set. The natural linewidth of this transition is 6 MHz, while the laser linewidth is less than 1 MHz. For the single-channel straight collimator, this peak has a narrow FWHM of 42 MHz, but contains broad wings visible up to 400 MHz detuning. For comparison, atoms coming out from the nozzle at 45° have an approximate Doppler shift of $\bar{\upsilon}\sin 45°/\lambda 32$ 270 MHz, showing that many atoms propagate at a very large angle to the main beam axis with the straight collimator. By comparison, the cascaded collimator with n=3 cascaded atomic channels has an even narrower FWHM of 18 MHz, indicating tremendous collimation, and the tail of the distribution has been completely suppressed. Both data sets were taken at the same source temperature of 100° C. as well as identical illumination conditions (probe laser power and beam waist), so the height of the spectral peaks can be directly compared between the two collimators subject to a temperature uncertainty of ±5° C. between the two ovens. That is, the peak height accurately reflects the actual number of atoms entering the probe laser volume in both cases. The peak height was larger by a factor of 2.5 for the straight collimator due to the one-dimensional nature of the spectrum, which only differentiates atoms based on their velocity $\upsilon_y$ along the laser propagation ($\hat{y}$) direction. Atoms with a finite velocity $\upsilon_x$ and the same value of $\upsilon_y$ are counted in the spectrum equally. For the straight collimator, there are many more such atoms compared with the cascaded collimator, which can explain the larger peak signal for the straight collimator.

Figure 10B:
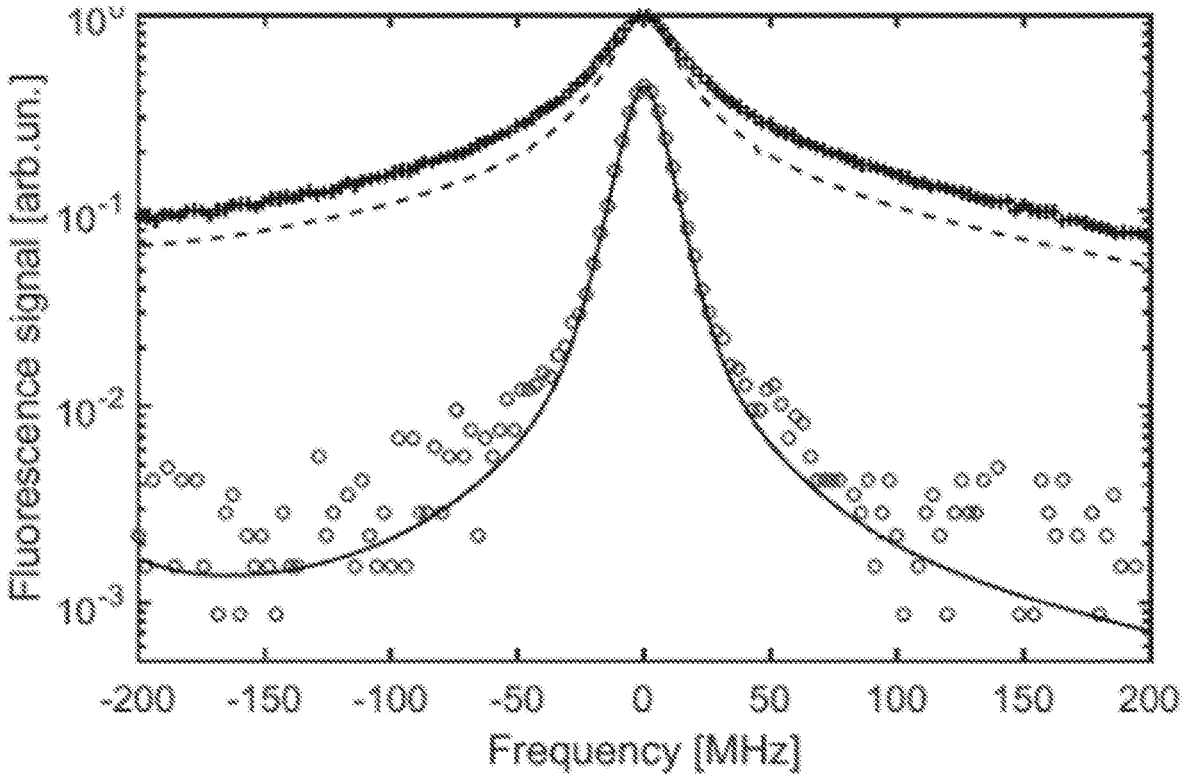
FIG. 10B is a graph of the data of FIG. 10A on a log scale and with a frequency range of ±200 MHz of the 2-3 transition.

FIG. 10B is a graph of the data of FIG. 10A on a log scale and with a frequency range of ±200 MHz of the 2-3 transition. The solid and dashed lines represent theoretical predictions for the spectral distribution of fluorescence. The theoretical curves combined the Molflow+ angular distributions with a master equation solution to the probe laser interaction with a $^{87}$Rb atom inclusive of hyperfine and Zeeman sub-levels. The agreement between the predicted and measured spectra confirm the high degree of purity of the cascaded collimator. The figure also shows that the wings of the distribution at 200 MHz detuning, corresponding to atoms moving at an angle of 30 degrees from the main axis, are reduced by a factor if greater than 70. The measured FWHM of 18 MHz was not much larger than the power-broadened natural linewidth 9 MHz of the transition. Using a deconvolution procedure, it is estimated that the transverse Doppler broadening had a HWHM=4 m/s, which implies a very narrow beam divergence angle $\theta_{1/2}$=0.013 rad. Broadening due to laser frequency noise and Zeeman shifts were at the 1 MHz level. Despite the small size of the collimator, therefore, the device shows a well-collimated beam. In comparison, free space collimators require a clean-up chamber with 10's of centimeter length to achieve the same beam divergence and suppression of off-axis backgrounds.

Figure 11:
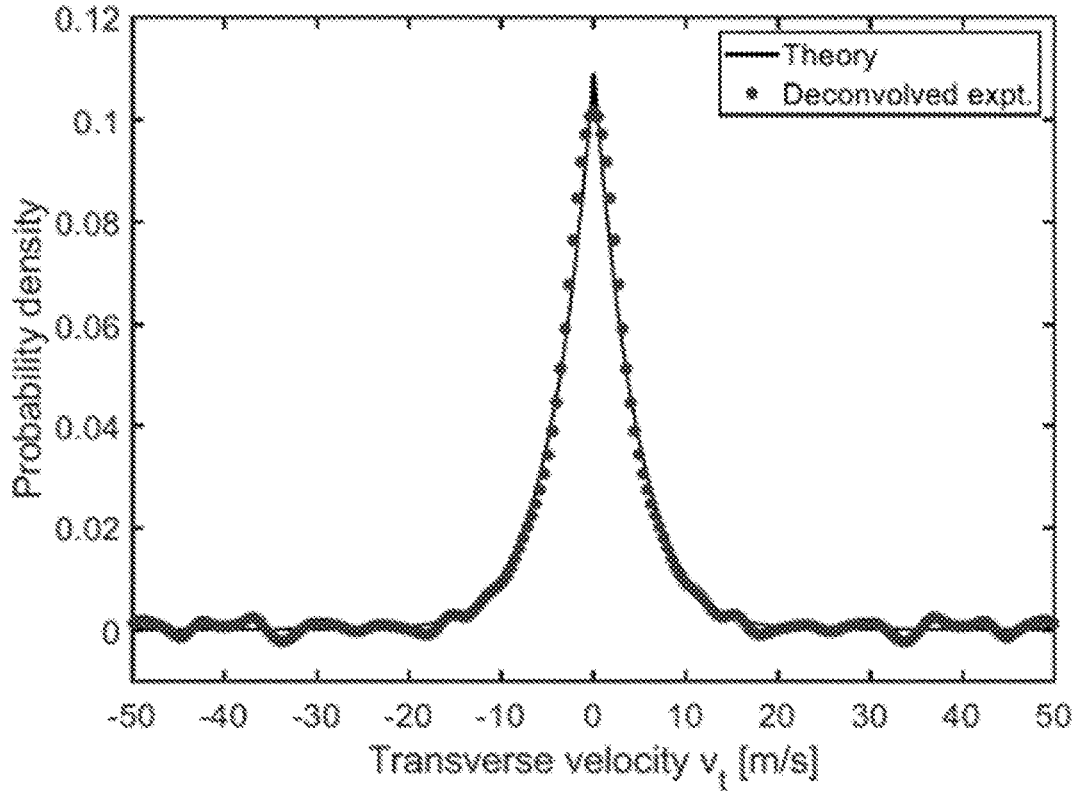
FIG. 11 is a graph of the deconvolved transverse velocity distribution as compared to the Monte-Carlo prediction for a cascaded collimator.

FIG. 11 is a graph of the deconvolved transverse velocity distribution as compared to the Monte-Carlo prediction for the cascaded collimator. The graph shows a very good agreement between the two. The velocity distribution has a sharp cusp at zero, dropping off rapidly (the deconvolution process resulted in unphysical oscillations in the wings of the data). Unlike the straight collimator, there is no long tail at large velocities, as those atoms have been effectively filtered out by the gap regions between successive atomic channels.

Figure 12:
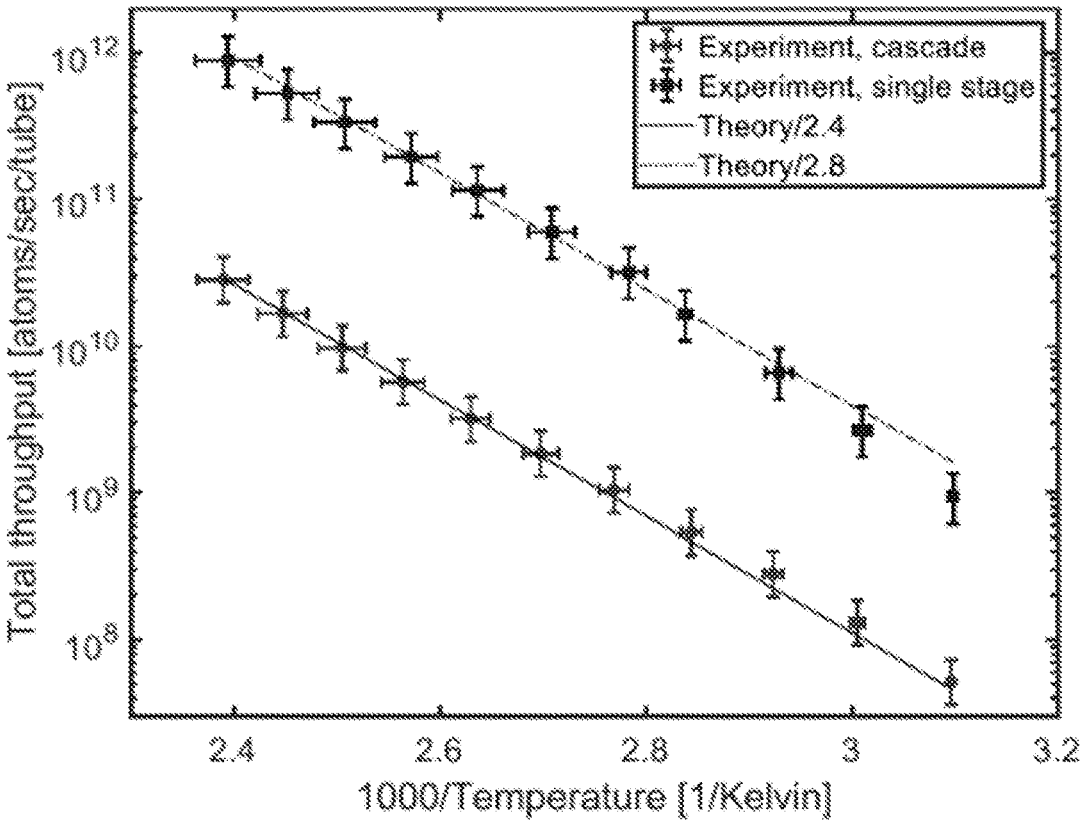
FIG. 12 is a graph of the measured throughput of a single-channel and a cascaded planar atomic collimator.

From the measured peak fluorescence and beam velocity distributions, the overall throughput of the two devices, over a broad range of temperatures from 50 to 150° C. corresponding to 3 orders of magnitude in flux, can be determined. FIG. 12 is a graph of the measured throughput of a single-channel and a cascaded planar atomic collimator. The data in the graph confirms that, although the on-axis beam brightness of the two collimators is the same, the cascaded collimator emits 40 times fewer atoms. Accounting for both $^{85}$Rb and $^{87}$Rb isotopes, it is estimated that the peak throughput of the cascaded collimator reached $3\times10^{10}$ atoms/s per atomic channel. For an exemplary device comprising 20 parallel (i.e., the configuration of FIG. 5A) cascaded atomic channels having two gap regions, this output corresponds to a total flux of up to $6\times10^{11}$ atoms/s from a collimator with a 0.2 mm$^2$ footprint.

Common Use Examples

Figure 13A:
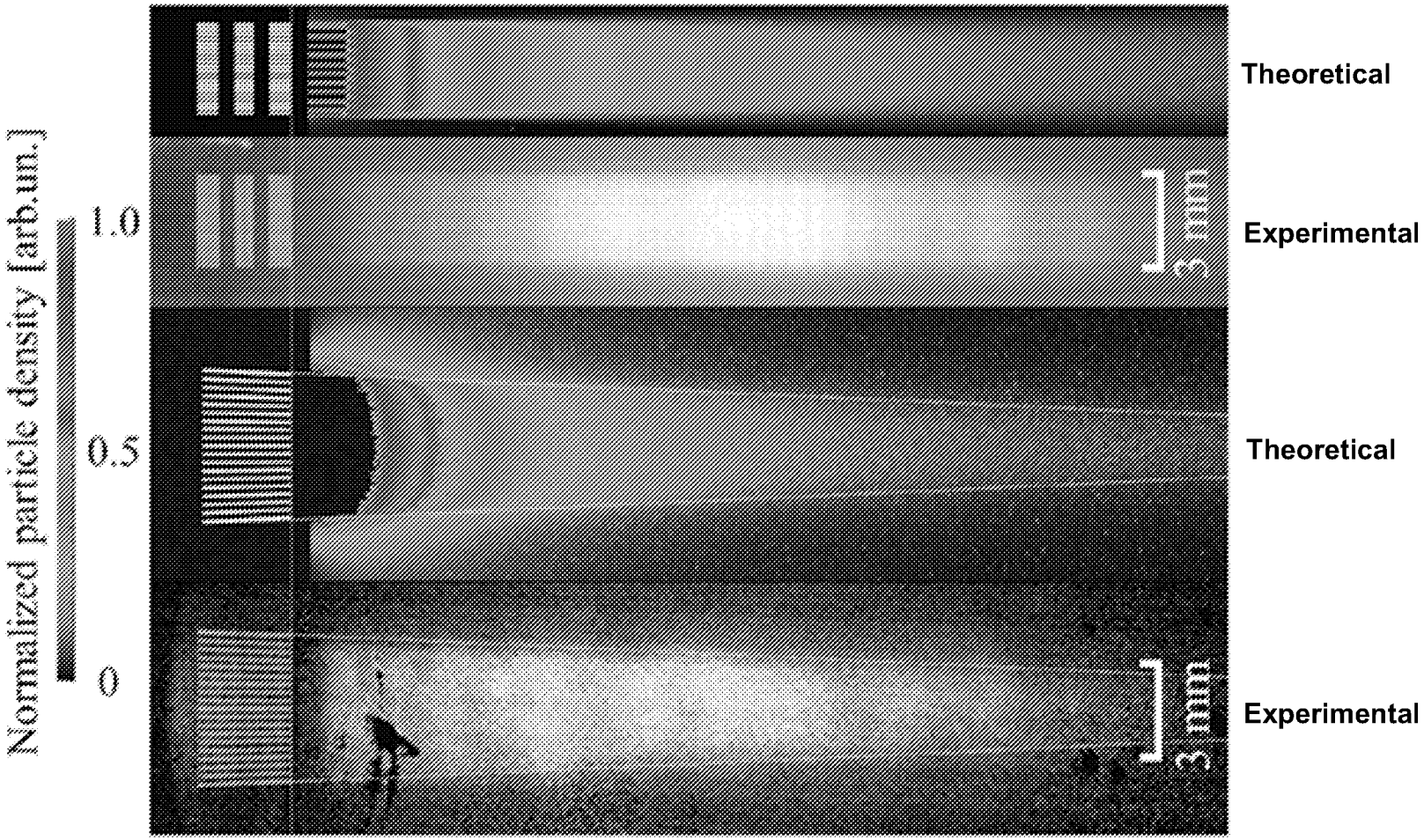
FIG. 13A depicts the theoretical and experimental results for a 20-parallel-channel cascaded collimator and a 19-focusing-channel straight collimator.
Figure 13B:
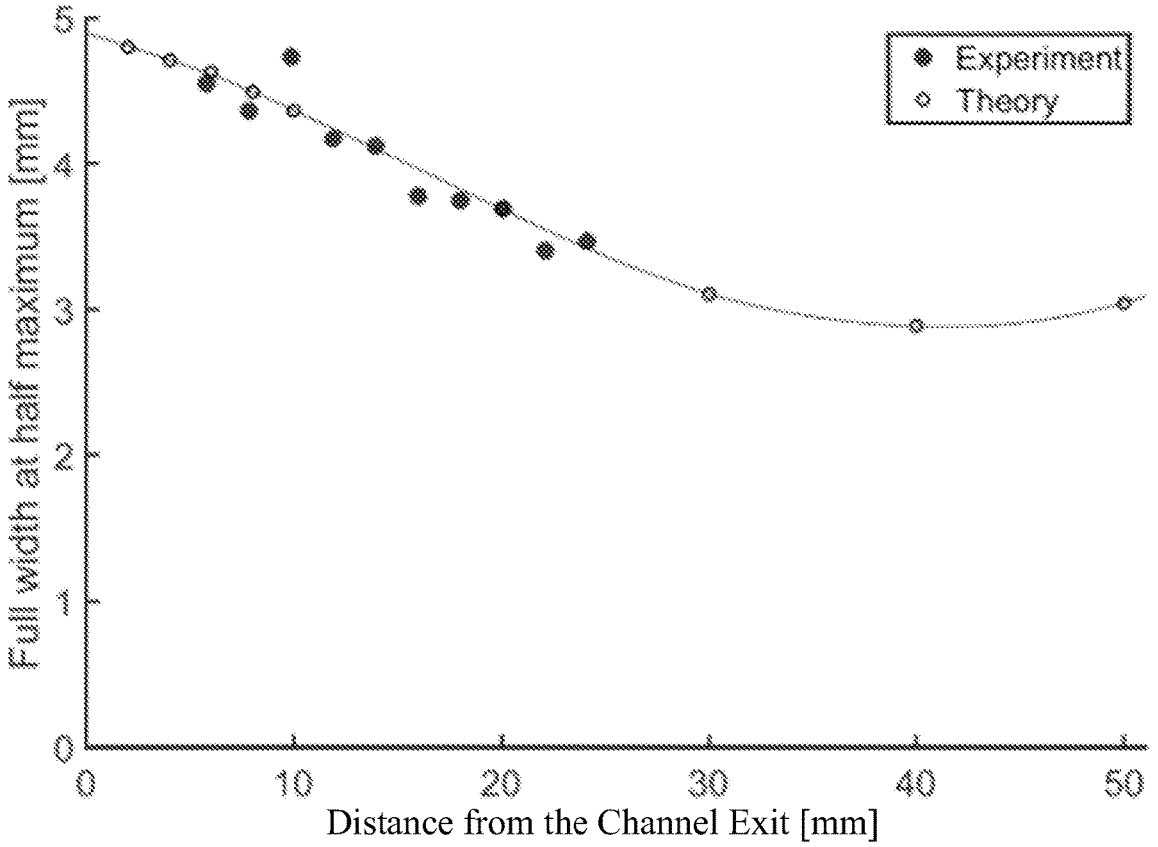
FIG. 13B is a graph of the FWHM (full-width at half-maximum) at distances from the channel exit for a converging, or focusing, atomic collimator.

As described herein, the present disclosure describes various designs for both single-channel and cascaded planar atomic collimators. The manufacturing methods described provide an amount of control over the geometries for atomic and molecular collisions. FIG. 13A depicts the theoretical and experimental results for a 20-parallel-channel cascaded collimator and a 19-focusing-channel straight collimator (i.e., the converging embodiment shown in FIG. 5C). The theoretical results are the corresponding Monte-Carlo simulations of the output particle density, and the experimental results are images taken by illuminating the atomic beam perpendicular to the atomic velocity such that longitudinal Doppler shifts played no role. The laser beam was expanded in size to 40 mm to cover the atomic beam near the channel exit. Due to the inhomogeneous Gaussian profile of the beam, the fluorescence intensity in the images does not directly correspond to atom density, but simply reflects the transverse spatial distribution of atoms along the atomic beam path. For the cascaded collimators this distribution does not change its size, whereas the focusing chip shows narrowing of the beam due to increasing overlap of the outputs of each channel. FIG. 13B is a graph of the FWHM at distances from the channel exit for the focusing chip. The data shows a decrease by ≅25% over a distance of 20 mm, in good agreement with the Monte-Carlo theory.

Figure 14:
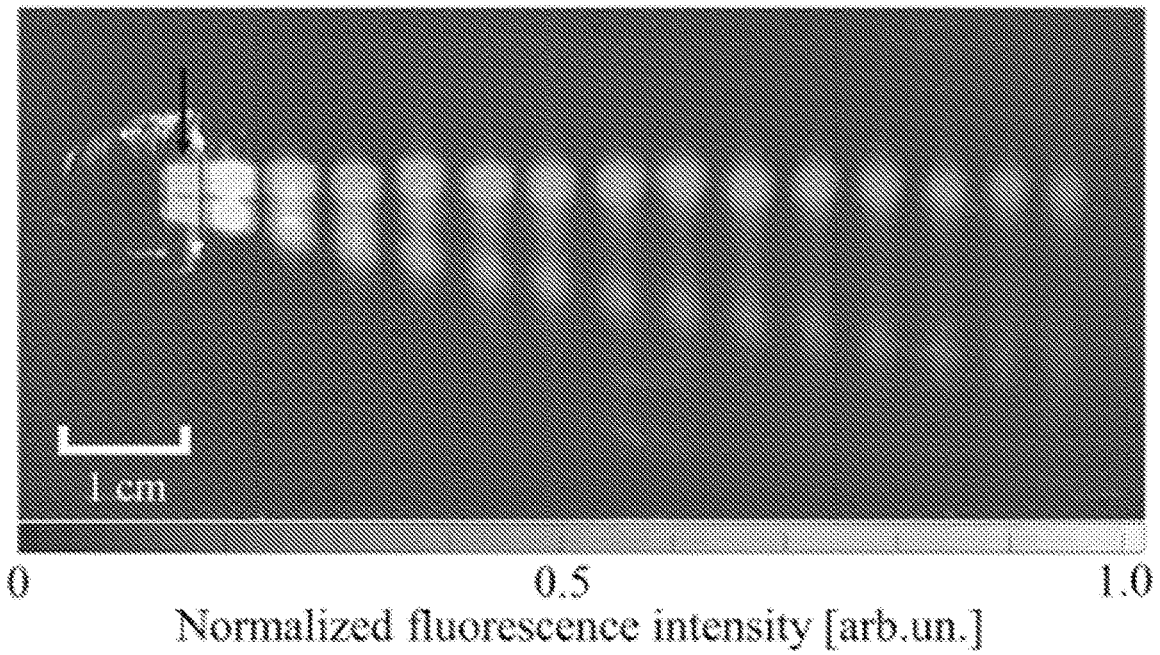
FIG. 14 is an image of the fluorescence intensity of a collimator with two propagating collimated beams at a relative angle of 12°.

FIG. 14 is an image of the fluorescence intensity of a collimator with two propagating collimated beams at a relative angle of 12°. As describe above in the discussion for FIG. 5C, some embodiments of the present-described systems may include a first set of parallel atomic channels and a second set of parallel atomic channels diverging (or converging) from each other at a relative angle. The embodiment shown in FIG. 14 is a diverging construct wherein the first parallel channels are offset from the second parallel channels at an angle of 12°. Such an embodiment may provide a platform to place two MEMS devices at each end of the two propagating atomic beams, wherein both MEMS devices share a single atom source.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A system comprising:

an atomic beam collimator comprising:

a first substrate having a planar surface;

a first atomic channel etched into the planar surface of the first substrate;

a second atomic channel etched into the planar surface of the first substrate and coplanar with the first atomic channel;

a third atomic channel etched into the planar surface of the first substrate and colinear with the first atomic channel;

a first gap disposed in the planar surface of the first substrate and between the first atomic channel and the third atomic channel;

a fourth atomic channel etched into the planar surface the first substrate and colinear with the second atomic channel; and a second gap disposed in the planar surface of the first substrate and between the second atomic channel and the fourth atomic channel.

2. The system of claim 1, further comprising:

an atom source configured to emit a plurality of atoms, such that a first portion of the plurality of atoms passes through the first atomic channel and a second portion of the plurality of atoms passes through the second atomic channel.

3. The system of claim 1, further comprising:

a second substrate positioned adjacent to the planar surface of the first substrate, the second substrate capping the first and second atomic channels.

4. The system of claim 3, wherein the second substrate comprises a first side and a second side, the first side positioned adjacent to the first substrate, and wherein the system further comprises:

a fifth atomic channel etched into the second side of the second substrate; and a sixth atomic channel etched into the second side of the second substrate, wherein the fifth atomic channel and the sixth atomic channel are coplanar.

5. The system of claim 4, wherein the atomic beam collimator further comprises:

a third substrate positioned adjacent to the second side of the second substrate, the third substrate capping the fifth and sixth atomic channels.

6. The system of claim 2, wherein the first and second atomic channels have a first end and a second end, the respective first ends proximate the atom source and the respective second ends distal to the atom source, and wherein a first distance between the first ends of the first and second atomic channels is greater than a second distance between the second ends of the first and second atomic channels.

7. The system of claim 1, wherein the atomic beam collimator further comprises:

a fifth atomic channel etched into the planar surface of the first substrate, wherein the fifth atomic channel is coplanar with the first atomic channel and the second atomic channel, wherein the first and second atomic channels are parallel along the first substrate, and wherein the third atomic channel is not parallel to the first and second atomic channels.

8. The system of claim 2, further comprising:

a microelectromechanical system device configured to receive atoms from the third and fourth atomic channels.

9. The system of claim 8, wherein the microelectromechanical system device is disposed on the first substrate.

10. A system comprising:

an atomic beam collimator comprising:

a first substrate having a planar surface;

a first atomic channel etched into the planar surface of the first substrate;

a second atomic channel etched into the planar surface of the first substrate and colinear with the first atomic channel; and a first gap disposed between the first and second atomic channels within the planar surface of the first substrate.

11. The system of claim 10, wherein the atomic beam collimator further comprises:

a third atomic channel etched into the planar surface of the first substrate;

a fourth atomic channel etched into the planar surface of the first substrate and colinear with the third atomic channel; and a second gap disposed between the third and fourth atomic channels, wherein the first, second, third, and fourth atomic channels are coplanar.

12. The system of claim 11, further comprising:

an atom source configured to emit a plurality of atoms, such that at least a first portion of the plurality of atoms pass through the first atomic channel, at least a first portion of the first portion of plurality of atoms pass through the second atomic channel, at least a second portion of the plurality of atoms pass through the third atomic channel, and at least a first portion of the second portion of the plurality of atoms pass through the fourth atomic channel.

13. The system of claim 11, wherein the atomic beam collimator further comprises:

a fifth atomic channel etched into the planar surface of the first substrate;

a sixth atomic channel etched into the planar surface of the first substrate and colinear with the fifth atomic channel; and a third gap disposed between the fifth and sixth atomic channels, wherein the first, second, third, fourth, fifth, and sixth atomic channels are coplanar.

14. The system of claim 11, further comprising:

a second substrate positioned adjacent to the planar surface of the first substrate, the second substrate capping the first, second, third, and fourth atomic channels.

15. The system of claim 14, wherein the second substrate comprises a first side and a second side, the first side positioned adjacent to the first substrate and the second side comprising a planar surface, wherein the second substrate comprises:

a fifth atomic channel etched into the planar surface of the second substrate;

a sixth atomic channel etched into the planar surface of the second substrate and colinear with the fifth atomic channel; and a third gap disposed between the fifth and sixth atomic channels, wherein the fifth and sixth atomic channels are coplanar.

16. The system of claim 13, wherein the first and third atomic channels are parallel along the first substrate, and wherein the fifth atomic channel is not parallel to the first and third atomic channels.

17. The system of claim 12, wherein the atom source is proximate the first atomic channel, the system further comprising:

a microelectromechanical system device disposed proximate the second atomic channel and configured to receive atoms from the second atomic channel.

18. A method comprising:

providing a substrate;

etching a first atomic channel into the substrate;

etching a second atomic channel into the substrate and in the same plane as the first atomic channel;

etching a third atomic channel into the substrate, the third atomic channel etched colinear with the first atomic channel;

etching a fourth atomic channel into the substrate, the fourth atomic channel etched colinear with the second atomic channel;

capping the first, second, third, and fourth atomic channels with a capping wafer; and providing an atom source configured to emit a plurality of atoms to pass through the first, second, third, and fourth atomic channels, wherein a first gap is disposed in the substrate between the first and third atomic channels, and wherein a second gap is disposed in the substrate between the second and fourth atomic channels.

19. The method of claim 18, wherein the first atomic channel and the second atomic channel comprise a length and a width, wherein the length of the first and second atomic channels is from 50 μm to 10 mm, and wherein the width of the first and second atomic channels is from 50 nm to 300 μm.

20. The method of claim 18, further comprising:

providing a microelectromechanical system device configured to receive at least a portion of the plurality of atoms from the first and second atomic channels, wherein the microelectromechanical system device is disposed on the substrate.

* * * * *